US010328689B2

(12) United States Patent
Hanagami et al.

(10) Patent No.: US 10,328,689 B2
(45) Date of Patent: Jun. 25, 2019

(54) FLOW PATH STRUCTURE, LIQUID EJECTING HEAD, LIQUID EJECTING APPARATUS, AND MANUFACTURING METHOD OF FLOW PATH STRUCTURE

(71) Applicant: SEIKO EPSON CORPORATION, Tokyo (JP)

(72) Inventors: Taiki Hanagami, Matsumoto (JP); Isamu Togashi, Matsumoto (JP); Ryota Kinoshita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 7 days.

(21) Appl. No.: 15/703,225

(22) Filed: Sep. 13, 2017

(65) Prior Publication Data

US 2018/0009220 A1 Jan. 11, 2018

Related U.S. Application Data

(63) Continuation of application No. 15/210,059, filed on Jul. 14, 2016, now Pat. No. 9,789,685.

(30) Foreign Application Priority Data

Jul. 24, 2015 (JP) ..... 2015-146552
Jul. 24, 2015 (JP) ..... 2015-146553
Jan. 8, 2016 (JP) ..... 2016-002826

(51) Int. Cl.
*B41J 2/045* (2006.01)
*B41J 2/14* (2006.01)
(Continued)

(52) U.S. Cl.
CPC ..... *B41J 2/04541* (2013.01); *B41J 2/04586* (2013.01); *B41J 2/1433* (2013.01);
(Continued)

(58) Field of Classification Search
CPC ..... B41J 2/04506; B41J 2/04505; B41J 2/04503; B41J 2/04501; B41J 2/04508;
(Continued)

(56) References Cited

U.S. PATENT DOCUMENTS

2009/0225138 A1 9/2009 Watanabe
2010/0156996 A1 6/2010 Oikawa et al.
2011/0083758 A1 4/2011 Tsujiuchi et al.
2011/0114207 A1 5/2011 Iketani et al.
(Continued)

FOREIGN PATENT DOCUMENTS

JP 2006205621 8/2006
JP 2009226943 10/2009
(Continued)

OTHER PUBLICATIONS

Notice of Allowance issued in U.S. Appl. No. 15/210,059 dated Jun. 19, 2017.
(Continued)

*Primary Examiner* — Kristal Feggins
(74) *Attorney, Agent, or Firm* — Workman Nydegger

(57) ABSTRACT

A flow path structure which forms a flow path of liquid, includes: a light absorbing member (first substrate) having absorbing properties with respect to laser light; a light transmitting member (second substrate) which is joined to the light absorbing member and has transmitting properties with respect to the laser light; a first flow path (flow path) which is surrounded by a welding interface between the light absorbing member and the light transmitting member; and a second flow path which is formed in a flow path pipe (flow path pipe) which protrudes from a front surface opposite of the welding interface in the light transmitting member, and communicates with the first flow path, in which the flow path pipe is included in a region of the first flow path in a plan view from a direction orthogonal to the welding interface.

9 Claims, 22 Drawing Sheets

(51) Int. Cl.
*B41J 2/155* (2006.01)
*B41J 2/16* (2006.01)

(52) U.S. Cl.
CPC ..... *B41J 2/14233* (2013.01); *B41J 2/155* (2013.01); *B41J 2/161* (2013.01); *B41J 2/162* (2013.01); *B41J 2/1623* (2013.01); *B41J 2/1632* (2013.01); *B41J 2/1634* (2013.01); *B41J 2002/14241* (2013.01); *B41J 2202/03* (2013.01); *B41J 2202/11* (2013.01); *B41J 2202/19* (2013.01); *B41J 2202/20* (2013.01)

(58) Field of Classification Search
CPC ..... B41J 2/04541; B41J 2/1433; B41J 2/162; B41J 2/1634; B41J 2/161; B41J 2/155; B41J 2/14233; B41J 2202/19; B41J 2202/20; H05K 999/99
See application file for complete search history.

(56) References Cited

U.S. PATENT DOCUMENTS

| | | | |
|---|---|---|---|
| 2011/0115850 | A1 | 5/2011 | Kudo et al. |
| 2014/0043395 | A1 | 2/2014 | Shimizu et al. |
| 2017/0021613 | A1 | 1/2017 | Hanagami et al. |

FOREIGN PATENT DOCUMENTS

| | | |
|---|---|---|
| JP | 2011104891 | 6/2011 |
| JP | 2011104892 | 6/2011 |
| JP | 2014054833 | 3/2014 |

OTHER PUBLICATIONS

Non-Final Office Action issued in U.S. Appl. No. 15/210,059 dated Mar. 24, 2017.
European Search Report for Application No. 16181002.3 dated Feb. 6, 2017.

FLOW PATH STRUCTURE, LIQUID EJECTING HEAD, LIQUID EJECTING APPARATUS, AND MANUFACTURING METHOD OF FLOW PATH STRUCTURE

CROSS REFERENCES TO RELATED APPLICATIONS

This application is a continuation of U.S. application Ser. No. 15/210,059, filed Jul. 14, 2016, which claims priority to Japanese Patent Application No. 2015-146552 filed on Jul. 24, 2015, Japanese Patent Application No. 2015-146553 filed on Jul. 24, 2015 and Japanese Patent Application No. 2016-002826 filed on Jan. 8, 2016, the entireties of which are incorporated by reference herein.

BACKGROUND

1. Technical Field

The present invention relates to a technology of ejecting liquid, such as ink.

2. Related Art

A liquid ejecting head which ejects liquid, such as ink, from a plurality of nozzles is suggested in the related art. For example, in JP-A-2011-104891, a configuration in which a groove is formed on each of opposite surfaces on two substrates, and a flow path of the liquid surrounded by a wall surface of the groove is formed in the liquid ejecting head by performing laser welding with respect to the periphery of the groove and by joining the two substrates, is disclosed. In JP-A-2011-104891, considering that the welding is performed insufficiently since the heat in an end portion region of a welding part is likely to be released when laser light is radiated, and heat energy of the laser light increases in the end portion region with the thickness of the end portion region thinner than that of other parts.

In addition, for example, JP-A-2009-226943 discloses a configuration in which stagnation of the liquid in a reservoir that supplies the liquid to a compression chamber which generates pressure for ejecting the liquid is suppressed. In JP-A-2011-104891, considering that the stagnation is likely to be generated in a confluence region of the liquid supplied from a liquid supply port of a reservoir, the stagnation in the confluence region is controlled with a side wall of the reservoir protrude in the confluence region of the liquid, thereby improving bubble discharge performance in the reservoir.

However, there is a case where, in a flow path formed in a substrate by the laser welding, a flow path pipe of another flow path which communicates with the flow path is formed to protrude from a front surface of the substrate. A part which protrudes from the substrate in the flow path pipe increases to be thicker than other parts of the substrate. Therefore, when performing the welding by radiating the laser light to the substrate from the front surface on which the flow path pipe protrudes, since the protruding part of the flow path pipe is thicker than other parts of the substrate, the laser light is likely to be attenuated compared to other parts. Therefore, welding unevenness due to insufficient welding is likely to be generated. In this case, the laser light may be radiated from a flat plane side on which the flow path pipe does not protrude, but there is also a case where the laser light is not radiated from the flat plane side since a projection from the substrate increases as a structure of the flow path or a configuration of the flow path substrate has become complicated in recent years.

In the above-described JP-A-2011-104891, the flow path pipe which forms another flow path that communicates with the flow path formed on the substrate, protrudes from the substrate. However, the laser light is radiated from a side opposite to a side on which the flow path pipe protrudes on the substrate, and the fact that the laser light is radiated from the side on which the flow path pipe protrudes is not described at all, and is not even considered. Furthermore, as illustrated in JP-A-2011-104891, in a case where a part which protrudes from the substrate in the flow path pipe is pushed out of the region of the flow path in the substrate in a plan view, if the laser light is radiated from the side on which the flow path pipe protrudes, and the welding is performed, since the laser light is attenuated at a part at which the flow path pipe protrudes, welding unevenness due to insufficient welding is likely to be generated. When welding unevenness between each substrate is generated, there is a concern that air tightness of the flow path deteriorates.

In addition, since a plurality of flow paths of the liquid are provided in the liquid ejecting head, a part at which the stagnation of the liquid is generated is not limited to the confluence region of the liquid when the liquid flows into the reservoir from a supply port as described in JP-A-2009-226943. For example, there is a case where a branch flow path which branches from a main flow path of the ink is formed, and in this case, even at a branch point of the flow path, there is a concern that the stagnation of the liquid is generated. Since a part of the liquid which flows in the main flow path diverges to the branch flow path, at the branch point of the main flow path and the branch flow path, a flow of the main flow path is pulled to the branch flow path according to the flow velocity or the flow path area, and the stagnation of the liquid is likely to be generated. However, in JP-A-2009-226943, the stagnation of the liquid generated at the branch point of the flow path is not assumed. Furthermore, since the flow of the branch point between the main flow path and the branch flow path as described above is completely different from the flow of the confluence region into which the liquid flows from the supply port at a comparatively large space, such as a reservoir, as described in JP-A-2009-226943, it is not possible to employ the configuration of JP-A-2009-226943 as it is.

SUMMARY

An advantage of some aspects of the invention is to achieve at least one of reduction in welding unevenness due to laser welding and improvement of discharge performance of bubbles at a branch point of a flow path by reducing welding unevenness due to laser welding suppressing stagnation of liquid at the branch point of the flow path provided with a branched flow path.

Aspect 1

According to a preferred aspect (Aspect 1) of the invention, there is provided a flow path structure which forms a flow path of liquid, including: a light absorbing member having absorbing properties with respect to laser light; a light transmitting member which is joined to the light absorbing member and has transmitting properties with respect to the laser light; a first flow path which is surrounded by a welding interface (in other words, a welding surface) between the light absorbing member and the light transmitting member in a plan view from a direction orthogonal to the welding interface; and a second flow path which is formed in a flow path pipe which protrudes from a front surface opposite of the welding interface in the light transmitting member, and communicates with the first flow path, in which the flow path pipe is included in a region of the first flow path in the plan view. In Aspect 1, since the flow path pipe which protrudes from the front surface opposite to the welding surface in the light transmitting member is included in the region of the first flow path in a plan view from the direction orthogonal to the welding surface, it is possible to prevent the welding surface which surrounds the first flow path from overlapping the pipe surface of the flow path pipe. Therefore, it is possible to effectively reduce welding unevenness. Accordingly, it is possible to form a flow path having high air tightness. In addition, in Aspect 1, since the flow path pipe formed in the light transmitting member may be included in the region of the first flow path, it is possible to improve the degree of freedom of the sectional area of other flow path pipes, for example, the flow path pipe provided in the light absorbing member.

Aspect 2

In a preferred example (Aspect 2) of Aspect 1, the second flow path may include an enlarged diameter portion having a first tapered portion which widens in a tapered shape to a downstream side of the first flow path, toward the first flow path. In Aspect 2, since the second flow path includes the enlarged diameter portion having the first tapered portion which widens in a tapered shape to the downstream side of the first flow path, toward the first flow path, the liquid which flows toward the downstream side from the upstream side of the first flow path can be likely to flow to the second flow path from the first flow path. Therefore, it is possible to suppress the stagnation of the liquid which is likely to be generated at this part. Accordingly, since the bubbles which stay at the stagnation part of the liquid are likely to be discharged, it is possible to improve the bubble discharge performance.

Aspect 3

In a preferred example (Aspect 3) of Aspect 2, the enlarged diameter portion of the second flow path may further have a second tapered portion which widens in a tapered shape to an upstream side of the first flow path, toward the first flow path, and an inclination angle (in other words, taper angle) with respect to the second flow path of the first tapered portion may be greater than an inclination angle with respect to the second flow path of the second tapered portion. In Aspect 3, since the enlarged diameter portion of the second flow path further has the second tapered portion which widens to the upstream side in addition to the first tapered portion which widens to the downstream side of the first flow path, it is possible to enlarge the sectional area of the enlarged diameter portion of the second flow path. Therefore, it is possible to make the liquid more likely to flow to the second flow path from the first flow path. In addition, in Aspect 3, since the inclination angle with respect to the second flow path of the first tapered portion which widens to the downstream side is greater than the inclination angle with respect to the second flow path of the second tapered portion which widens in a tapered shape to the upstream side, compared to a case where the inclination angle is the same with respect to both of the first tapered portion and the second tapered portion, it is possible to prevent the sectional area of the second flow path from becoming extremely large. Therefore, it is possible to suppress deterioration of the flow velocity. In this manner, since it is possible to make the liquid more likely to flow to the second flow path from the first flow path while suppressing deterioration of the flow velocity, it is possible to further improve the discharge performance of the bubbles.

Aspect 4

In a preferred example (Aspect 4) of Aspect 2 or 3, an end portion of the enlarged diameter portion of the second flow path may be opened to an opposing surface which opposes the light absorbing member, in the light transmitting member. In Aspect 4, since the end portion of the enlarged diameter portion of the second flow path is opened to the opposing surface which opposes the light absorbing member, in the light transmitting member, it is likely to form the enlarged diameter portion in the second flow path.

Aspect 5

In a preferred example (Aspect 5) of any one of Aspects 2 to 4, a plurality of the second flow paths may be formed from an inlet flow path which communicates with the first flow path to the downstream side, the plurality of second flow paths may include a flow path disposed in the end portion on the downstream side of the first flow path, and a flow path disposed between the end portion on the downstream side of the first flow path and the inlet flow path, and, in the light absorbing member, a projection portion which protrudes toward the enlarged diameter portion of the flow path, may be formed at a position opposing the flow path disposed between the end portion on the downstream side of the first flow path and the inlet flow path in the plurality of second flow paths. In Aspect 5, since the projection portion which protrudes toward the enlarged diameter portion of the flow path, is formed at the position opposing the flow path disposed between the end portion on the downstream side of the first flow path and the inlet flow path in the plurality of second flow paths, at a branch point of the first flow path and each second flow path, a flow along the projection portion of the first flow path and the enlarged diameter portion of the second flow path is generated. Therefore, the flow toward the second flow path from the first flow path is more likely to be formed. Accordingly, since the stagnation of the liquid is suppressed at each branch point and the bubbles are likely to be discharged, it is possible to further improve the discharge performance of the bubbles at each branch point.

Aspect 6

In a preferred example (Aspect 6) of any one of Aspects 2 to 5, the first flow path may be formed from one end portion to the other end portion, the inlet flow path may be disposed between the one end portion and the other end portion, and the second flow path may be disposed at both of the one end portion and the other end portion. In Aspect 6, since the first flow path is formed from one end portion to the other end portion, the inlet flow path is disposed between one end portion and the other end portion, and the second flow path is disposed at both of one end portion and the other end portion, the liquid which flows from the inlet flow path branches and is likely to flow not only in the second flow path in one end portion but also in the second flow path in the other end portion. According to this, compared to a case where the inlet flow path is not provided between one end portion and the other end portion, since it is possible to suppress the stagnation in one end portion and the other end portion of the first flow path, the bubbles which stay in the stagnation are likely to be discharged. Accordingly, while suppressing the stagnation in one end portion and the other end portion of the first flow path, it is possible to reduce welding unevenness of laser welding.

Aspect 7

The flow path structure according to a preferred example (Aspect 7) of any one of Aspects 1to 6 may further include a third flow path which is formed in a flow path pipe that protrudes on a side opposite to the flow path pipe in which the second flow path is formed with respect to the welding surface, and communicates with the first flow path. The number of flow path pipes which forms the third flow path may be less than the number of flow path pipes which forms the second flow path, and the sectional area of the third flow path may be greater than the sectional area of the second flow path. In Aspect 7, since the sectional area of the third flow path is greater than the sectional area of the second flow path, it is possible to reduce pressure loss in the flow path. In particular, since the pressure loss is likely to be generated in a case where the plurality of second flow paths which communicate with the first flow path are present, an effect that the reduction of the pressure loss is possible, is large. Furthermore, since the third flow path is formed in a flow path pipe that protrudes on the side opposite to the flow path pipe in which the second flow path is formed with respect to the welding surface, that is, on the side opposite to the side to which the laser light is radiated, even when the sectional area of the third flow path is large, it is possible to reduce welding unevenness of the laser welding. Accordingly, while suppressing the pressure loss, it is possible to reduce welding unevenness of the laser welding.

Aspect 8

In a preferred example (Aspect 8) of Aspect 7, an outer circumference of the flow path pipe in which the third flow path is formed may have a size which exceeds a region of the first flow path in a plan view from the direction orthogonal to the welding surface. In Aspect 8, since the outer circumference of the flow path pipe in which the third flow path is formed has the size which exceeds the region of the first flow path in a plan view from the direction orthogonal to the welding surface, it is possible to further enlarge the sectional area of the third flow path. Therefore, it is possible to improve the effect of reducing the pressure loss of the first flow path.

Aspect 9

The flow path structure according to a preferred example (Aspect 9) of Aspect 7 or 8 may further include two light transmitting members which are joined to the light absorbing member and have transmitting properties with respect to the laser light. The light absorbing member may be stacked being interposed between the two light transmitting members, and the flow path pipe of the second flow path may be formed at one or both of the two light transmitting members. In Aspect 9, since two light transmitting members which are joined to the light absorbing member and have transmitting properties with respect to the laser light, are provided, it is possible to radiate the laser light from the front surfaces of both of the two light transmitting members, and to weld each of the two light transmitting members to the light absorbing member. In this case, since the flow path pipe of the second flow path included in the region of the first flow path is formed at one or both of the two light transmitting members, even when the laser light is radiated from the front surface of any light transmitting member, it is possible to reduce welding unevenness.

Aspect 10

In a preferred example (Aspect 10) of Aspect 9, the flow path pipe of the second flow path may be formed at one of the two light transmitting members, and the flow path pipe of the third flow path may be formed at the other one of the two light transmitting members. In Aspect 10, since the flow path pipe of the second flow path is formed at one of the two light transmitting members, and the third flow path is formed at the other one, it is possible to further enlarge the sectional area of the third flow path. Therefore, it is possible to reduce the pressure loss of the first flow path. In addition, by joining a second substrate on which the flow path pipe of the second flow path included in the region of the first flow path is formed, to a first substrate, by the laser welding, it is possible to reduce welding unevenness.

Aspect 11

In a preferred example (Aspect 11) of Aspect 9 or 10, a filter interposed between the two light transmitting members may be provided in the light absorbing member. In Aspect 11, since the filter interposed between the two light transmitting members is provided in the light absorbing member, compared to a case where the filter is provided in any of the two light transmitting members, it is not necessary to dispose the filter not to overlap in the radiation direction of the laser light. Therefore, it is possible to improve the degree of freedom of design, such as the disposition or the size of the filter.

Aspect 12

According to aspect preferred aspect (Aspect 12) of the invention, there is provided a liquid ejecting head including: the flow path structure according to any one of Aspects 1 to 11; and nozzles which eject liquid from the flow path structure by driving a driving element. In Aspect 12, since the flow path structure according to any one of Aspects 1 to 11 is provided, welding unevenness due to the laser welding is reduced. Therefore, it is possible to provide the liquid ejecting head in which a flow path having high air tightness is formed.

Aspect 13

According to aspect preferred aspect (Aspect 13) of the invention, there is provided a liquid ejecting apparatus including: a transporting mechanism which transports a medium; and the liquid ejecting head according to the aspect which ejects liquid to the medium. In Aspect 12, since the liquid ejecting head according to Aspect 12 is provided, welding unevenness due to the laser welding is reduced. Therefore, it is possible to provide the liquid ejecting apparatus in which a flow path having high air tightness is formed. A preferable example of the liquid ejecting apparatus is a printing apparatus which ejects ink to the medium, such as a printing paper sheet, but the use of the liquid ejecting apparatus according to the invention is not limited to printing.

Aspect 14

According to a preferred aspect (Aspect 14) of the invention, there is provided a manufacturing method of a flow path structure, the method including: forming a flow path groove of a first flow path on one or both of opposing surfaces of a light absorbing member having absorbing properties with respect to laser light and a light transmitting member having transmitting properties with respect to the laser light; forming a flow path pipe which protrudes from a front surface opposite to the opposing surface which opposes the light absorbing member, in the light transmitting member and forming a second flow path which communicates with the first flow path in the flow path pipe; stacking the light absorbing member and the light transmitting member so that the opposing surfaces thereof are in contact with each other; and forming the first flow path by radiating the laser light toward the light transmitting member and by forming a welding surface that surrounds the flow path groove without overlapping the flow path pipe in the radiation direction. In Aspect 14, in the radiation direction (including the direction orthogonal or diagonal to the welding surface) of the laser light, the welding surface which surrounds the first flow path does not overlap a pipe surface of the flow path pipe. Therefore, it is possible to effectively reduce welding unevenness. Accordingly, it is possible to form a flow path having high air tightness.

Aspect 15

In a preferred example (Aspect 15) of Aspect 14, the second flow path may include an enlarged diameter portion having a first tapered portion which widens in a tapered shape to a downstream side of the first flow path, toward the first flow path. In Aspect 15, since the second flow path includes the enlarged diameter portion having the first tapered portion which widens in a tapered shape to the downstream side of the first flow path, toward the first flow path, the liquid which flows to the downstream side from the upstream side of the first flow path can be likely to flow to the second flow path from the first flow path. Therefore, it is possible to suppress the stagnation of the liquid generated at the part. Accordingly, since the bubbles which stay at the stagnation part of the liquid are likely to be discharged, it is possible to improve the bubble discharge performance.

Aspect 16

In a preferred example (Aspect 16) of Aspect 15, the enlarged diameter portion of the second flow path may further have a second tapered portion which widens in a tapered shape to an upstream side of the first flow path, toward the first flow path, and an inclination angle with respect to the second flow path of the first tapered portion may be greater than an inclination angle with respect to the second flow path of the second tapered portion. In Aspect 16, since the enlarged diameter portion of the second flow path further has the second tapered portion which widens to the upstream side in addition to the first tapered portion which widens to the downstream side of the first flow path, it is possible to enlarge the sectional area of the enlarged diameter portion of the second flow path. Therefore, it is possible to make the liquid more likely to flow to the second flow path from the first flow path. In addition, in Aspect 16, since the inclination angle with respect to the second flow path of the first tapered portion which widens to the downstream side is greater than the inclination angle with respect to the second flow path of the second tapered portion which widens in a tapered shape to the upstream side, compared to a case where the inclination angle is the same with respect to both the first tapered portion and the second tapered portion, it is possible to prevent the sectional area of the second flow path from becoming extremely large. Therefore, it is possible to suppress deterioration of the flow velocity. In this manner, since it is possible to make the liquid more likely to flow to the second flow path from the first flow path while suppressing deterioration of the flow velocity, it is possible to further improve the discharge performance of the bubbles.

Aspect 17

In a preferred example (Aspect 17) of Aspect 15 or 16, an end portion of the enlarged diameter portion of the second flow path may be opened to an opposing surface which opposes the light absorbing member, in the light transmitting member. In Aspect 17, since the end portion of the enlarged diameter portion of the second flow path is opened to the opposing surface which opposes the light absorbing member, in the light transmitting member, it is likely to form the enlarged diameter portion in the second flow path.

Aspect 18

In a preferred example (Aspect 18) of any one of Aspects 15 to 17, a plurality of the second flow paths may be formed from an inlet flow path which communicates with the first flow path to the downstream side, the plurality of second flow paths may include a flow path disposed in the end portion on the downstream side of the first flow path, and a flow path disposed between the end portion on the downstream side of the first flow path and the inlet flow path, and, in the light absorbing member, a projection portion which protrudes toward the enlarged diameter portion of the flow path, may be formed at a position opposing the flow path disposed between the end portion on the downstream side of the first flow path and the inlet flow path in the plurality of second flow paths. In Aspect 18, since the projection portion which protrudes toward the enlarged diameter portion of the flow path, is formed at a position opposing the flow path disposed between the end portion on the downstream side of the first flow path and the inlet flow path in the plurality of second flow paths, at the branch point of the first flow path and the second flow path, a flow along the projection portion of the first flow path and the enlarged diameter portion of the second flow path, is generated. Therefore, the flow from the first flow path to the second flow path is more likely to be formed. Accordingly, since the stagnation of the liquid is suppressed at each branch point and the bubbles are likely to be discharged, it is possible to further improve the discharge performance of the bubbles at each branch point.

Aspect 19

In a preferred example (Aspect 19) of any one of Aspects 15 to 18, the first flow path may be formed from one end portion to the other end portion, the inlet flow path may be disposed between the one end portion and the other end portion, and the second flow path may be disposed at both of the one end portion and the other end portion. In Aspect 19, the first flow path is formed from one end portion to the other end portion, the inlet flow path is disposed between one end portion and the other end portion, and the second flow path is disposed at both of one end portion and the other end portion, the liquid which flows from the inlet flow path branches, and is likely to flow not only in the second flow path of one end portion but also in the second flow path of the other end portion. According to this, compared to a case where the inlet flow path is not provided between one end portion and the other end portion, since it is possible to suppress the stagnation in one end portion and the other end portion of the first flow path, the bubbles which stay in the stagnation are likely to be discharged. Accordingly, while suppressing the stagnation in one end portion and the other end portion of the first flow path, it is possible to reduce welding unevenness of the laser welding.

Aspect 20

In a preferred example (Aspect 20) of any one of Aspects 14 o 19, a third flow path which is formed in a flow path pipe that protrudes on a side opposite to the flow path pipe in which the second flow path is formed with respect to the welding surface, and communicates with the first flow path, may further be provided, the number of flow path pipes which forms the third flow path is formed may be less than the number of flow path pipes which forms the second flow path, and the sectional area of the third flow path may be greater than the sectional area of the second flow path. In Aspect 20, since the sectional area of the third flow path is greater than the sectional area of the second flow path, it is possible to reduce the pressure loss in the flow path. In particular, since the pressure loss is likely to be generated in a case where the plurality of second flow paths which communicate with the first flow path are present, an effect that the reduction of the pressure loss is possible is large. Furthermore, since the third flow path is formed in the flow path pipe which protrudes on a side opposite to the flow path pipe in which the second flow path is formed with respect to the welding surface, that is, on a side opposite to the side to which the laser light is radiated, even when the sectional area of the third flow path is enlarged, it is possible to reduce welding unevenness of the laser welding. Accordingly, while reducing the pressure loss, it is possible to reduce welding unevenness of the laser welding.

Aspect 21

In a preferred example (Aspect 21) of Aspect 20, an outer circumference of the flow path pipe in which the third flow path is formed may have a size which exceeds a region of the first flow path in a plan view from a direction orthogonal to the welding surface. In Aspect 21, since the outer circumference of the flow path pipe in which the third flow path is formed has the size which exceeds the region of the first flow path in a plan view from the direction orthogonal to the welding surface, it is possible to further enlarge the sectional area of the third flow path. Therefore, it is possible to improve the effect of reducing the pressure loss of the first flow path.

Aspect 22

In a preferred example (Aspect 22) of Aspect 20 or 21, two light transmitting members which are joined to the light absorbing member and have transmitting properties with respect to the laser light, may further be provided, the light absorbing member may be stacked being interposed between the two light transmitting members, and the flow path pipe of the second flow path may be formed at one or both of the two light transmitting members. In Aspect 22, since two light transmitting members which are joined to the light absorbing member and have transmitting properties with respect to the laser light, are further provided, by radiating the laser light from the front surface of both of the two light transmitting members, it is possible to weld each of the two light transmitting members to the light absorbing member. In this case, since the flow path pipe of the second flow path included in the region of the first flow path is formed at one or both of the two light transmitting members, even when the laser light is radiated from the front surface of any light transmitting member, it is possible to reduce welding unevenness.

Aspect 23

In a preferred example (Aspect 23) of Aspect 22, the flow path pipe of the second flow path may be formed at one of the two light transmitting members, and the flow path pipe of the third flow path may be formed at the other one of the two light transmitting members. In Aspect 23, since the flow path pipe of the second flow path is formed at one of the two light transmitting members, and the flow path pipe of the third flow path is formed at the other one, it is possible to further enlarge the sectional area of the third flow path. Therefore, it is possible to reduce the pressure loss of the first flow path. In addition, by joining the second substrate on which the flow path pipe of the second flow path included in the region of the first flow path is formed, to a first substrate, by the laser welding, it is possible to reduce welding unevenness.

Aspect 24

In a preferred example (Aspect 24) of Aspect 22 or 23, a filter interposed between the two light transmitting members may be provided in the light absorbing member. In Aspect 24, since the filter interposed between the two light transmitting members is provided in the light absorbing member, compared to a case where the filter is provided in any of the two light transmitting members, it is not necessary to dispose the filter not to overlap in the radiation direction of the laser light. Therefore, it is possible to improve the degree of freedom of the design, such as the disposition or the size of the filter.

Aspect 25

In a preferred example (Aspect 25) of any one of Aspects 14 to 24, an angle of the radiation direction of the laser light with respect to the welding surface is constant. In this case, since the angle of the radiation direction of the laser light with respect to the welding surface is constant, compared to a case where the radiation angle of the laser light changes, it is easy to perform the laser welding.

Aspect 26

According to a preferred aspect (Aspect 26), there is provided a flow path structure which forms a flow path of liquid, including: a first substrate; a second substrate joined to the first substrate; and a first flow path which is surrounded by a fixing surface on which the first substrate and the second substrate are fixed, in which a second flow path which branches from the first flow path and in which the liquid flows in the direction intersecting with the fixing surface, is formed in one of the first substrate and the second substrate, and a projection portion which protrudes toward the second flow path at a branch point of the first flow path and the second flow path is formed in the other one of the first substrate and the second substrate, the projection portion includes a wall surface on the upstream side and a wall surface on the downstream side in the first flow path, and the wall surface on the upstream side of the projection portion has an inclined surface which is inclined so that the height of the projection portion increases toward the downstream side with respect to the direction of the flow in the first flow path.

In Aspect 26, since the second flow path which branches from the first flow path is provided, the projection portion which protrudes toward the second flow path is formed at the branch point of the first flow path and the second flow path, and the inclined surface which is inclined so that the height of the projection portion increases toward the downstream side with respect to the direction of the flow in the first flow path, is provided on the wall surface on the upstream side of the projection portion, at the branch point of the first flow path and the second flow path, a part of the liquid which flows in the first flow path forms a flow which is guided to the second flow path being oriented to the inclined surface having the wall surface on the upstream side of the projection portion. According to this, the stagnation of the liquid is suppressed at the branch point of the first flow path and the second flow path, and the bubbles are likely to be discharged from the second flow path. Accordingly, it is possible to improve the bubble discharge performance at each branch point.

Aspect 27

In a preferred example (Aspect 27) of Aspect 26, the wall surface on the downstream side of the projection portion may have the inclined surface which is inclined so that the height of the projection portion decreases toward the downstream side with respect to the direction of the flow in the first flow path, and the inclination angle of the wall surface on the upstream side of the projection portion with respect to the direction of the flow in the first flow path may be greater than the inclination angle of the wall surface on the downstream side of the projection portion with respect to the direction of the flow in the first flow path.

In Aspect 27, since the inclination angle of the wall surface on the upstream side of the projection portion with respect to the direction of the flow in the first flow path is greater than the inclination angle of the wall surface on the downstream side, the liquid which flows in the first flow path can be likely to flow to the second flow path. Accordingly, since it is possible to enhance the suppression effect of the stagnation of the branch point, and the bubbles are more likely to be discharged from the second flow path, it is possible to further improve the discharge performance of the bubbles at each branch point. In addition, in Aspect 27, since the inclination angle of the wall surface on the downstream side of the projection portion with respect to the direction of the flow in the first flow path is smaller than the inclination angle of the wall surface on the upstream side, the flow of the liquid which flows further on the downstream side than the projection portion in the first flow path becomes smooth. Therefore, it is possible to reduce the stagnation of the liquid which flows further on the downstream side than the projection portion.

Aspect 28

In a preferred example (Aspect 28) of Aspect 26 or 27, in the sectional area of the first flow path on the section orthogonal to the direction of the flow in the first flow path, the sectional area of the first flow path further on the downstream side than the projection portion, may be smaller than the sectional area of the first flow path further on the upstream side than the projection portion. In a case where the sectional area of the first flow path is constant, the flow velocity of the liquid which flows in the first flow path is reduced when passing through the projection portion or the branch point, and the bubble discharge performance deteriorates.

At this point, in Aspect 28, since the sectional area of the first flow path further on the downstream side than the projection portion is smaller than the sectional area of the first flow path further on the upstream side than the projection portion, it is possible to suppress deterioration of the flow velocity of the liquid which flows in the first flow path further on the downstream side than the projection portion. Accordingly, it is possible to improve the discharge performance of the bubbles further on the downstream side than the projection portion.

Aspect 29

In a preferred example (Aspect 29) of Aspect 28, the first substrate may be the light absorbing member having absorbing properties with respect to the laser light, the second substrate may be the light transmitting member having transmitting properties with respect to the laser light, the fixing surface which surrounds the first flow path may be the welding surface which is welded by the laser light, the second flow path may be formed in the flow path pipe which protrudes from the front surface opposite to the welding surface in the second substrate and is included in the region of the first flow path in a plan view from the direction orthogonal to the welding surface, and the height of the first flow path further on the downstream side than the projection portion may be lower than the height of the first flow path further on the upstream side than the projection portion, among the heights of the first flow path on the section orthogonal to the direction of the flow in the first flow path.

In Aspect 29, since the height of the first flow path further on the downstream side than the projection portion is lower than the height of the first flow path further on the upstream side than the projection portion, among the heights of the first flow path on the section orthogonal to the direction of the flow in the first flow path, the sectional area of the first flow path further on the downstream side than the projection portion becomes smaller than the sectional area of the first flow path further on the upstream side than the projection portion. Accordingly, since it is possible to suppress deterioration of the flow velocity of the liquid which flows in the first flow path further on the downstream side than the projection portion, it is possible to improve the discharge performance of the bubbles further on the downstream side than the projection portion.

In addition, in Aspect 29, since the second flow path is formed in the flow path pipe which protrudes from the front surface opposite to the welding surface in the second substrate and is included in the region of the first flow path in a plan view from the direction orthogonal to the welding surface, it is possible to make the welding surface which surrounds the first flow path not to overlap the pipe surface of the flow path pipe. Therefore, it is possible to effectively reduce welding unevenness of the welding surface welded by the laser light. Accordingly, it is possible to form a flow path having high air tightness. Furthermore, in Aspect 29, since the sectional area of the first flow path is adjusted by the height of the first flow path, compared to a case where the sectional area of the first flow path is adjusted by the width of the first flow path, the region of the first flow path surrounded by the welding surface does not narrow. Therefore, it is significantly effective that it is not necessary to adjust the size of the flow path pipe in accordance with the width of the first flow path so that the welding surface which surrounds the first flow path does not overlap the pipe surface of the flow path pipe.

Aspect 30

In a preferred example (Aspect 30) of any one of Aspects 26 to 29, the second flow path may include the enlarged diameter portion having a tapered portion which widens in a tapered shape to the downstream side of the first flow path, toward the branch point of the first flow path, and when the projection portion and the enlarged diameter portion of second flow path are viewed in a plan view on the section along the direction of the flow in the first flow path, a virtual line which extends from the wall surface on the upstream side of the projection portion along the inclined surface may pass through the region in which the tapered portion of the enlarged diameter portion is formed.

In Aspect 30, since the enlarged diameter portion having a tapered portion which widens in a tapered shape to the downstream side of the first flow path, is provided toward the branch point of the first flow path, and when the projection portion and the enlarged diameter portion of second flow path are viewed in a plan view on the section along the direction of the flow in the first flow path, a virtual line which extends from the wall surface on the upstream side of the projection portion along the inclined surface passes through the region in which the tapered portion of the enlarged diameter portion is formed, it is possible to guide a part of the flow of the liquid of the first flow path to the tapered portion of the enlarged diameter portion formed in the second flow path along the inclination surface on which the wall surface on the upstream side of the projection portion extends. Accordingly, since it is possible to make the flow of the liquid of the first flow path likely to flow to the second flow path, it is possible to improve the effect of improving the discharge performance of the bubbles.

Aspect 31

In a preferred example (Aspect 31) of any one of Aspects 26 to 30, the plurality of second flow paths which branch from the first flow path may be provided, and in a case where there are N ($1 \leq N$) branch points on the downstream side of a first branch point toward the downstream side from the upstream side of the first flow path, among a plurality of branch points of the first flow path and the second flow path, when the height of the first flow path on the section orthogonal to the direction of the flow in the first flow path is hp, and when a ratio of the height of the projection portion with respect to the height hp of the first flow path is X, the ratio X of the height of the projection portion of an M-th ($1 \leq M \leq N$) branch point from the upstream side of the first flow path, is within a range of $1-(N-M+2)/(N+1)<X<1-((N-M+1)/(N+1))$. It is possible to adjust the sectional area of the first flow path at each branch point by the height of the projection portion. In this case, since it is possible to suppress deterioration of the flow velocity as the height of the projection portion increases, to that extent, it is possible to improve the discharge performance of the bubbles. However, when the height of the projection portion becomes extremely high, the area of the wall surface of the projection portion with which the flow of the liquid in the first flow path comes into contact increases. Therefore, the pressure loss increases, and rather, the flow velocity deteriorates. At this point, in Aspect 31, it is possible to calculate a preferable range of the height of the projection portion at each branch point in order to achieve both the effect of improving the discharge performance of the bubbles and the effect of suppressing the increase in the pressure loss. In other words, in Aspect 31, since the ratio X of the height of the projection portion of the M-th ($1 \leq M \leq N$) branch point from the upstream side of the first flow path is within the range of $1-(N-M+2)/(N+1)<X<1-((N-M+1)/(N+1))$, it is possible to achieve both the effect of improving the discharge performance of the bubbles and the effect of suppressing the increase in the pressure loss.

Aspect 32

In a preferred example (Aspect 32) of any one of Aspects 26 to 31, the first substrate may be the light absorbing member having absorbing properties with respect to the laser light, the second substrate may be the light transmitting member having the transmitting properties with respect to the laser light, the fixing surface which surrounds the first flow path may be the welding surface which is welded by the laser light, the first flow path may be formed in one of first substrate and the second substrate. In Aspect 32, since the first flow path surrounded by the welding surface welded by the laser light is formed in one of the first substrate and the second substrate, compared to a case where the flow path groove of the first flow path is welded to be provided in both of the first substrate and the second substrate, when the first substrate and the second substrate are stacked to oppose each other, even when any of the first substrate and the second substrate is generated, it is possible to form the predetermined first flow path.

Aspect 33

According to a preferred aspect (Aspect 33) of the invention, there is provided a liquid ejecting head including: the flow path structure according to any one of Aspects 26 to 32; and nozzles which eject the liquid from the flow path structure by driving of a driving element. A preferable example of the liquid ejecting head is a printing apparatus which ejects the ink, but the use of the liquid ejecting apparatus according to the invention is not limited to printing.

BRIEF DESCRIPTION OF THE DRAWINGS

The invention will be described with reference to the accompanying drawings, wherein like numbers reference like elements.

DESCRIPTION OF EXEMPLARY EMBODIMENTS

Liquid Ejecting Apparatus

Figure 1:
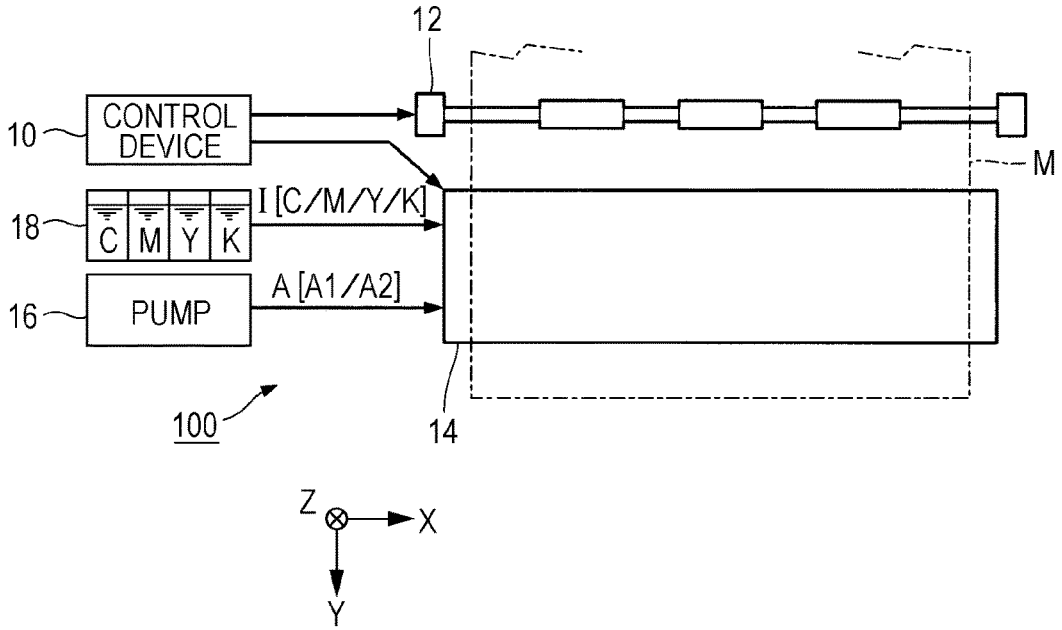
FIG. 1 is a configuration view of a printing apparatus which employs a liquid ejecting apparatus according to a first embodiment of the invention.

First, a liquid ejecting apparatus according to an embodiment of the invention will be described by using an ink jet type printing apparatus as an example. FIG. 1 is a partial configuration view of a printing apparatus 100 according to the embodiment of the invention. The printing apparatus 100 is a liquid ejecting apparatus which ejects ink which is an example of liquid to a printing medium (ejecting target) M, such as a printing paper sheet, and includes a control device 10, a transporting mechanism 12, a liquid ejecting head 14, and a pump 16. A liquid container (ink cartridge) 18 which stores a plurality colors of ink I is mounted in the printing apparatus 100. In the first embodiment, the ink I of four colors, such as cyan (C), magenta (M), yellow (Y), and black (B) is stored in the liquid container 18.

The control device 10 integrally controls each element of the printing apparatus 100. The transporting mechanism 12 transports the printing medium M in the Y direction based on the control by the control device 10. However, a structure of the transporting mechanism 12 is not limited to the above-described example. The pump 16 is an air supply device which supplies air A (A1, A2) of two systems to the liquid ejecting head 14 based on the control by the control device 10. The air A1 and the air A2 are gas used in controlling the flow path on the inside of the liquid ejecting head 14. The pump 16 can independently pressurize each of the air A1 and the air A2 to each other. The liquid ejecting head 14 ejects the ink I supplied from the liquid container 18 to the printing medium M based on the control by the control device 10. The liquid ejecting head 14 of the first embodiment is a line head which is long in the X direction intersecting with the Y direction. In addition, hereinafter, the direction perpendicular to the X-Y plane (plane parallel to a front surface of the printing medium M) will be described as the Z direction. The ejecting direction of the ink I by the liquid ejecting head 14 corresponds to the Z direction.

Liquid Ejecting Head

Figure 2:
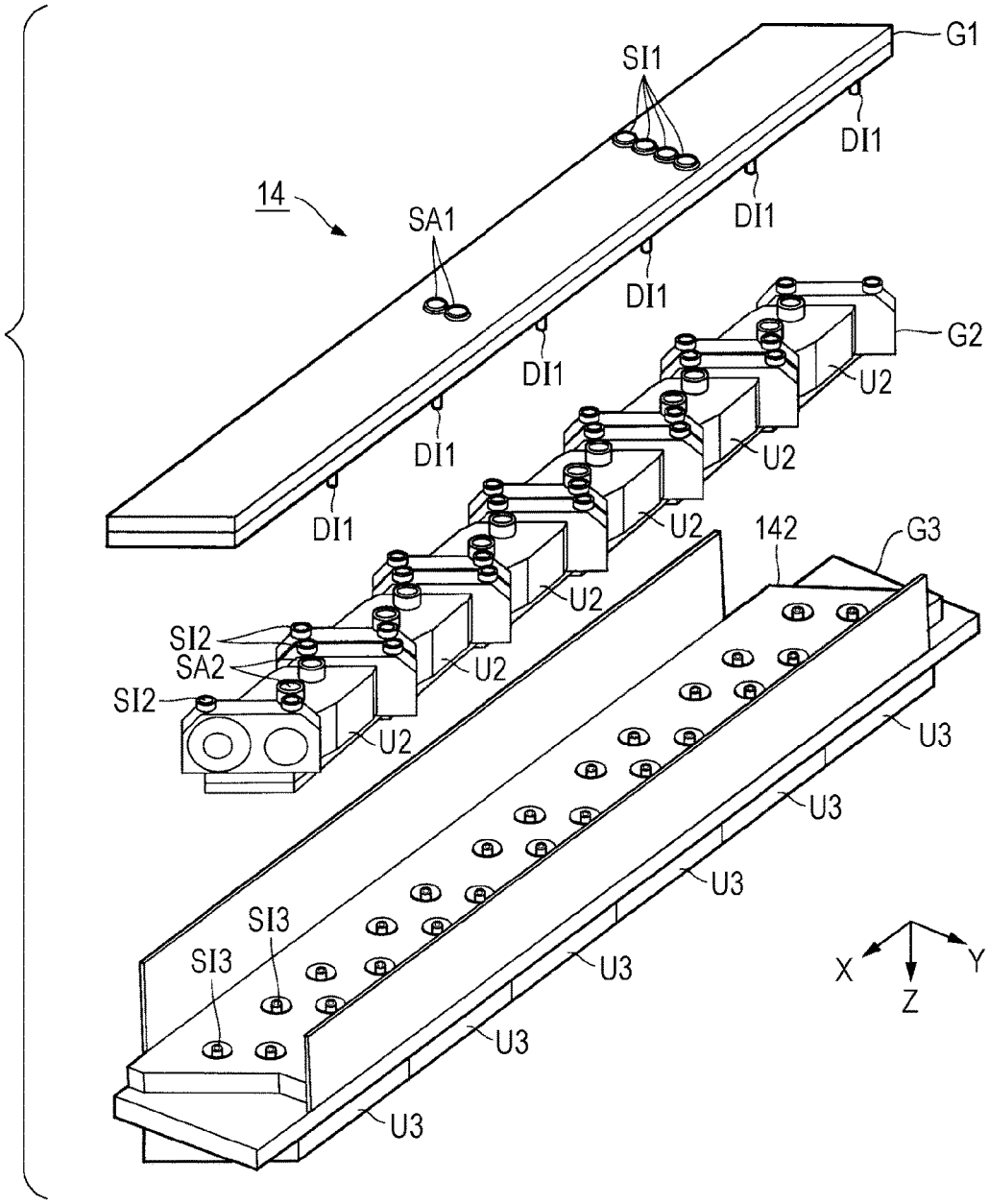
FIG. 2 is an exploded perspective view of a liquid ejecting head of the first embodiment.
Figure 3:
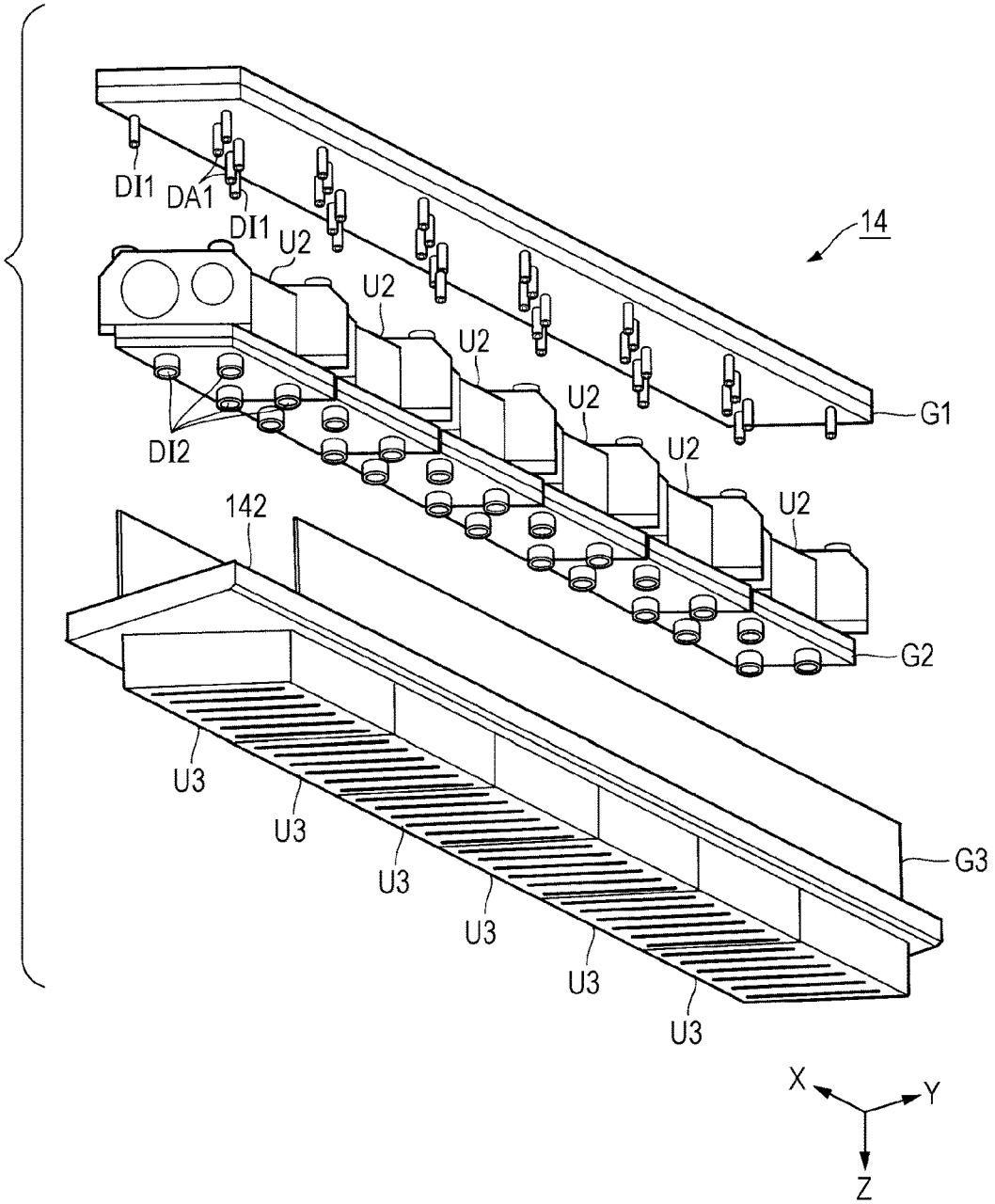
FIG. 3 is an exploded perspective view in a case where the liquid ejecting head of the first embodiment is viewed from another angle.

FIGS. 2 and 3 are exploded perspective views illustrating a configuration of the liquid ejecting head 14 illustrated in FIG. 1. As illustrated in FIGS. 2 and 3, the liquid ejecting head 14 is configured to include a flow path structure G1, a liquid path control portion G2, and a liquid ejecting portion G3. The flow path structure G1, the liquid path control portion G2, and the liquid ejecting portion G3 are accumulated in the Z direction in this order. The liquid ejecting portion G3 is a structure which accommodates and supports six liquid ejecting units U3 in a housing 142.

Figure 4:
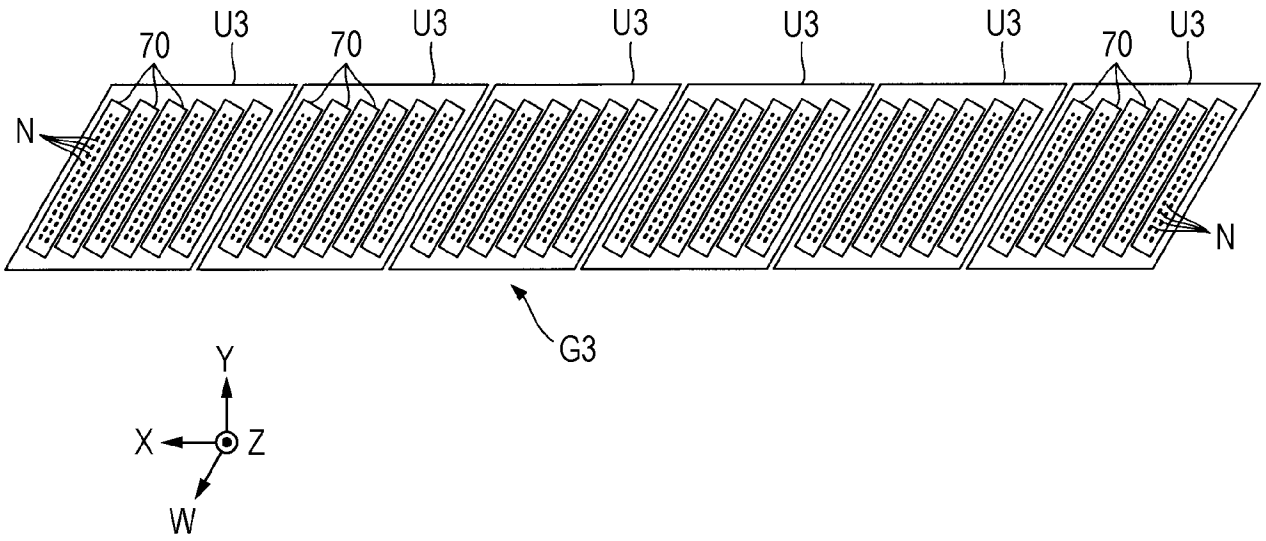
FIG. 4 is a plan view when the liquid ejecting head of the first embodiment is viewed from a printing medium side.

FIG. 4 is a plan view on an opposing surface which opposes the printing medium M in the liquid ejecting portion G3. As illustrated in FIG. 4, six liquid ejecting units U3 are arranged along the X direction. Each liquid ejecting unit U3 is provided with a plurality (six in the example illustrated in the first embodiment) of ejecting head portions 70 arranged along the X direction. Each ejecting head portion 70 includes a head chip which ejects the ink I from a plurality of nozzles N. The plurality of nozzles N of one ejecting head portion 70 are arranged in two rows along the W direction which is inclined by a predetermined angle with respect to the X direction and the Y direction. The ink I of four systems (four colors) are supplied in parallel to each ejecting head portion 70 of the liquid ejecting unit 3. The plurality of nozzles N of one ejecting head portion 70 are divided in four sets, and the inks I different in each set are ejected.

The air A (A1, A2) of two systems are supplied from the pump 16 to the flow path structure G1 together with the supply of the ink I of four systems from the liquid container 18. The flow path structure G1 distributes each of the ink I of four systems and each air A of two systems, to six systems which correspond to liquid ejecting units U3 different from each other. In other words, the distribution number (six) of the ink I of one system by the flow path structure G1 exceeds the number K (K=4) of the types of the ink I.

The liquid path control portion G2 is an element which controls the flow path (for example, opening and closing of the flow path or the pressure in the flow path) of the liquid ejecting head 14, and is configured to include six flow path control units U2 which correspond to liquid ejecting units U3 different from each other. The ink I of four systems and the air A of two systems are supplied to six flow path control units U2 in parallel as being distributed by the flow path structure G1. Each flow path control unit U2 controls the opening and closing or the pressure of the flow path of the ink I of four systems distributed to each liquid ejecting unit U3 by the flow path structure G1, in accordance with the air A of two systems.

Figure 5:
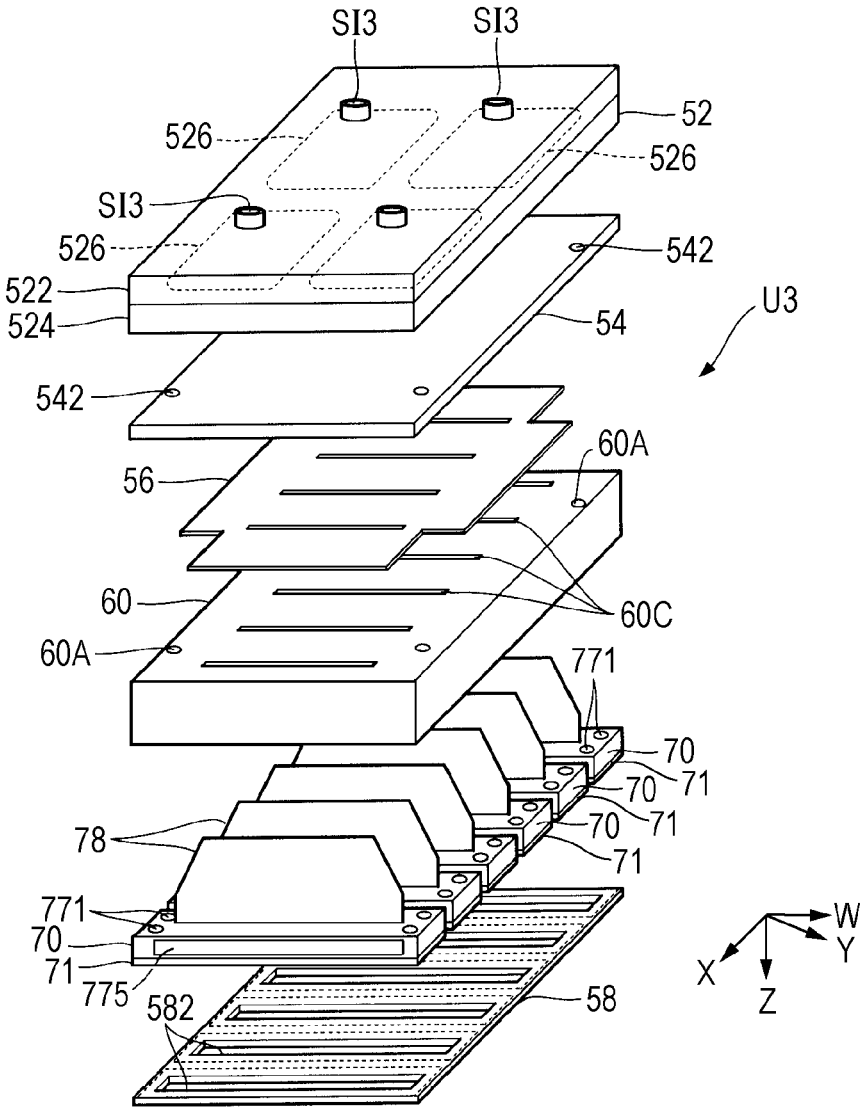
FIG. 5 is an exploded perspective view of a liquid ejecting unit illustrated in FIG. 2.

After the distribution by the flow path structure G1, the ink I of four systems which pass through each flow path control unit U2 is supplied to six liquid ejecting units U3 in parallel. As illustrated in FIG. 5 which will be described later, each liquid ejecting unit U3 is provided with a liquid distributing portion 60. The liquid distributing portion 60 distributes each ink I of four systems supplied from the flow path control unit U2 of the previous stage, to six systems which corresponds to ejecting head portions 70 different from each other. In other words, the ink I of four systems after the distribution is supplied to each of six ejecting head portions 70 in parallel by the liquid distributing portion 60. Each ejecting head portion 70 ejects ink I of each of four systems from the nozzles N different from each other.

As illustrated in FIG. 2, four supply ports SI3 are formed on an opposing surface which opposes the liquid path control portion G2 in each liquid ejecting unit U3 of the liquid ejecting portion G3. In a state where the liquid path control portion G2 and the liquid ejecting portion G3 (housing 142) are fixed to each other, each flow path pipe DI2 which forms an outlet flow path of the flow path control unit U2, is inserted into each supply port SI3 of each liquid ejecting unit U3. Therefore, the ink I of each system is supplied to four supply ports SI3 of each liquid ejecting unit U3, in parallel from the flow path pipe DI2 of the flow path control unit U2.

FIG. 5 is an exploded perspective view of one arbitrary liquid ejecting unit U3. As illustrated in FIG. 5, the liquid ejecting unit U3 is configured to join six ejecting head portions 70 fixed to a fixing plate 58, to an accumulating body of a filter portion 52, a communicating member 54, a basic wiring substrate 56, and the liquid distributing portion 60. The filter portion 52 is an element which removes the bubbles or foreign substances contained in each ink I supplied from the liquid path control portion G2. As illustrated in FIG. 5, in the filter portion 52, four supply ports SI3 to which each ink I is supplied via the liquid path control portion G2 are formed, and four filters 526 which correspond to the ink I supplied from each supply port SI3 are provided. The communicating member 54 makes an outflow port of four filter portions 52 communicate with the liquid distributing portion 60. The communicating member 54 is a flat plate material formed of an elastic material (for example, rubber), and forms four through-holes 542 which communicate with each outflow port of four filter portions 52. The liquid distributing portion 60 distributes each ink I of four systems supplied from each supply port 60A via each through-hole 542 of the communicating member 54, to six systems which correspond to each ejecting head portion 70.

A separate wiring base plate 78 is joined to each of ejecting head portions 70. The separate wiring base plate 78 is inserted into an insertion port (slit) 60C formed in the liquid distributing portion 60, and is joined to the basic wiring substrate 56. Each wiring base plate 78 is a flexible wiring substrate (chip on film (COF)) for electrically connecting the basic wiring substrate 56 and each ejecting head portion 70. The fixing plate 58 is a member having a shape of a flat plate which supports each ejecting head portion 70, and is formed of, for example, a metal having high rigidity, such as stainless steel. As illustrated in FIG. 5, six opening portions 582 which correspond to the ejecting head portions 70 different from each other, are formed in the fixing plate 58. Each opening portion 582 is a rectangular through-hole which is long in the W direction in a plan view.

Figure 6:
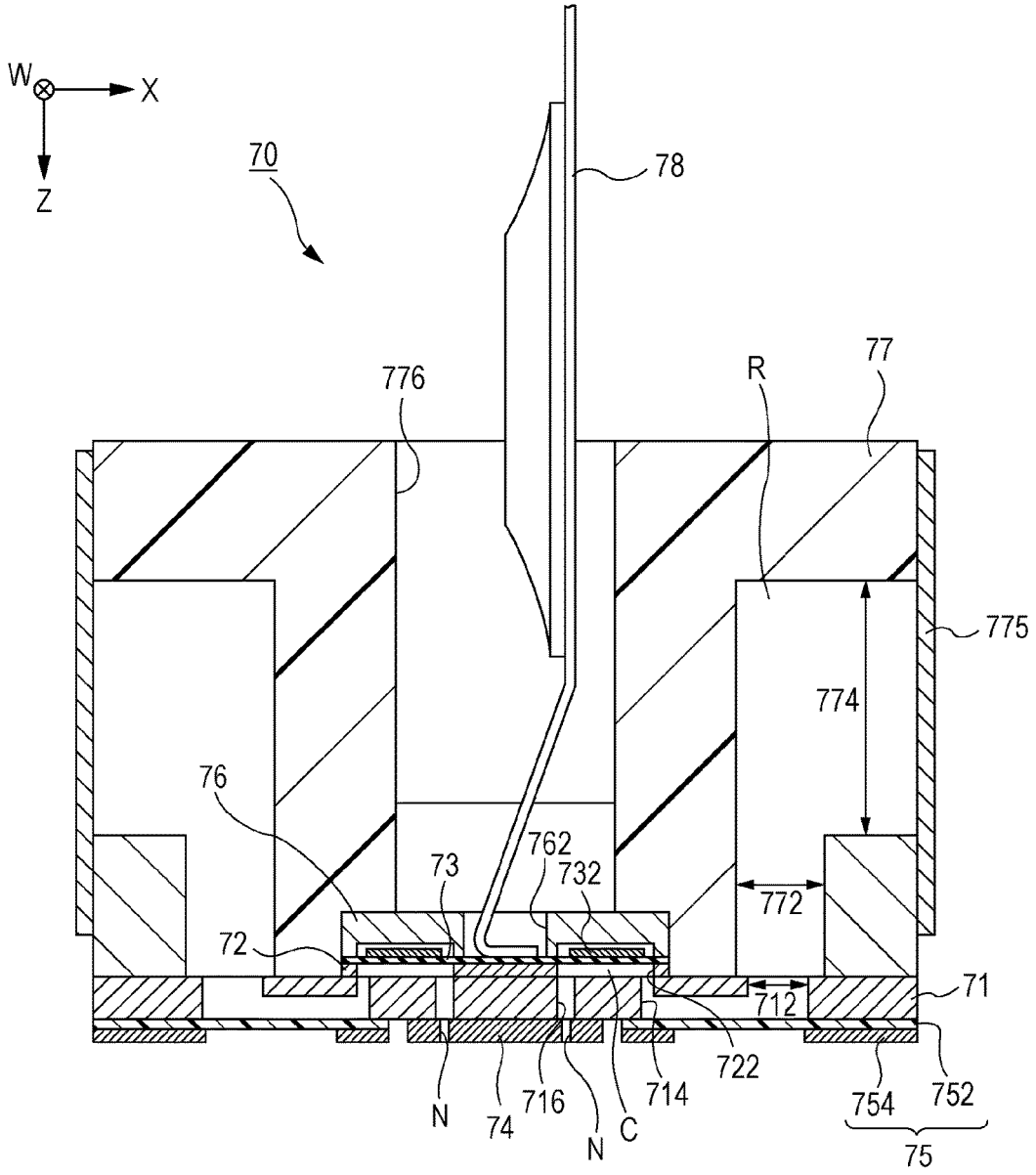
FIG. 6 is a sectional view of an ejecting head portion illustrated in FIG. 5.

FIG. 6 is a sectional view (section perpendicular to the W direction) of one ejecting head portion 70. As illustrated in FIG. 6, the ejecting head portion 70 accumulates a pressure chamber forming substrate 72 and an oscillation plate 73 on one front surface of a flow path forming substrate 71, and includes a head chip in which a nozzle plate 74 and the compliance substrate 75 are installed on the other front surface. The plurality of nozzles N are formed on the nozzle plate 74. In addition, as illustrated in FIG. 6, since a structure which corresponds to each row of the nozzles N is formed substantially symmetrically in one ejecting head portion 70, hereinafter, a structure of the ejecting head portion 70 will be described considering one row of nozzles N for convenience.

The flow path forming substrate 71 is a flat plate material which configures the flow path of the ink I. In the flow path forming substrate 71, an opening portion 712, a supply flow path 714, and a communicating flow path 716, are formed. The supply flow path 714 and the communicating flow path 716 are formed in each nozzle N, and the opening portion 712 continuously connected across the plurality of nozzles N which eject the ink I of one system. The pressure chamber forming substrate 72 is a flat plate material in which the plurality of opening portions 722 which correspond to the nozzles N different from each other are formed. The flow path forming substrate 71 or the pressure chamber forming substrate 72 is formed, for example, on a silicon single crystalline substrate.

The compliance substrate 75 is a mechanism which suppresses (absorbs) pressure variation in the flow path of the ejecting head portion 70, and is configured to include a sealing plate 752 and a supporting body 754. The sealing plate 752 is a film-like flexible member, and the supporting body 754 fixes the sealing plate 752 to the flow path forming substrate 71 so that the opening portion 712 and each supply flow path 714 of the flow path forming substrate 71 are blocked.

The oscillation plate 73 is installed on the front surface opposite to the flow path forming substrate 71 in the pressure chamber forming substrate 72. The oscillation plate 73 is a member having a shape of a flat plate which can elastically oscillate, and is configured of an accumulating layer of an elastic film formed of an elastic material, such as a silicon oxide, and an insulation film formed of an insulation material, such as zirconium oxide. As illustrated in FIG. 6, the oscillation plate 73 and the flow path forming substrate 71 oppose each other at an interval on the inner side of each opening portion 722 formed on the pressure chamber forming substrate 72. A space nipped by the flow path forming substrate 71 and the oscillation plate 73 on the inner side of each opening portion 722, functions as a pressure chamber (cavity) C which applies pressure to the ink. The pressure chambers C which communicate with each nozzle N are respectively arranged along the W direction.

On the front surface opposite to the pressure chamber forming substrate 72 in the oscillation plate 73, piezoelectric elements 732 which function as driving elements corresponding to each nozzle N, are respectively formed. Each piezoelectric element 732 is an accumulating body which interposes a piezoelectric body between electrodes that opposes each other. As the piezoelectric element 732 oscillates together with the oscillation plate 73 by the supply of a driving signal, the pressure in the pressure chamber C varies, and the ink I in the pressure chamber C is ejected from the nozzle N. Each piezoelectric element 732 is sealed and protected by a protecting plate 76 fixed to the oscillation plate 73.

A supporting body 77 is fixed to the flow path forming substrate 71 and the protecting plate 76. The supporting body 77 is integrally formed, for example, by molding a resin material. In the supporting body 77, a recessed portion 772 which configures a liquid storage portion (reservoir) R is formed together with the opening portion 712 of the flow path forming substrate 71. An opening of the recessed portion 772 is blocked by a circumferential edge of the opening portion 712 of the flow path forming substrate 71 in a state of communicating with the opening portion 712 of the flow path forming substrate 71. In the recessed portion 772, an opening portion 774 which is opened to a side surface of the supporting body 77 is formed, and the opening portion 774 is blocked by a lid portion 775.

The liquid storage portion R is configured of a space made of the recessed portion 772 of the supporting body 77, the opening portion 774, and an opening portion 322 of a flow path forming portion 32. In this manner, in the opening portion 774, it is possible to increase a volume of the liquid storage portion R by forming the opening portion 774, compared to a case where the opening portion 774 is not formed. In addition, the opening portion 774 of the supporting body 77 may not be formed. The above-described sealing plate 752 of the compliance substrate 75 configures the wall surface (bottom surface) of the liquid storage portion R, and absorbs the pressure variation of the ink in the liquid storage portion R.

As illustrated in FIG. 5, in each ejecting head portion 70, a supply port 771 which supplies the ink I of each system from the outflow port of the liquid distributing portion 60 is formed, and the supply port 771 communicates with the liquid storage portion R. Accordingly, the ink I of each system after the distribution by the liquid distributing portion 60 is supplied and stored in the liquid storage portion R via the supply port 771 of the ejecting head portion 70 from the outflow port of the liquid distributing portion 60. The ink I stored in the liquid storage portion R is distributed and fills each pressure chamber C by the plurality of supply flow paths 714, and is ejected to the outside (printing medium M side) passing through the communicating flow path 716 and the nozzle N from each pressure chamber C.

An end portion of the separate wiring base plate 78 is joined to the oscillation plate 73 illustrated in FIG. 6. The separate wiring base plate 78 is a flexible substrate (flexible wiring substrate) in which the wiring for transferring the driving signal or the power voltage to each piezoelectric element 732 is formed. The separate wiring base plate 78 protrudes via a slit 762 formed in the protecting plate 76 and a slit 776 formed in the supporting body 77, and is connected to the basic wiring substrate 56 as described above. The driving signal or the power voltage is supplied to the piezoelectric element 732 of each ejecting head portion 70 via each separate wiring base plate 78 from the basic wiring substrate 56.

Configuration of Flow Path Structure in First Embodiment

Figure 7:
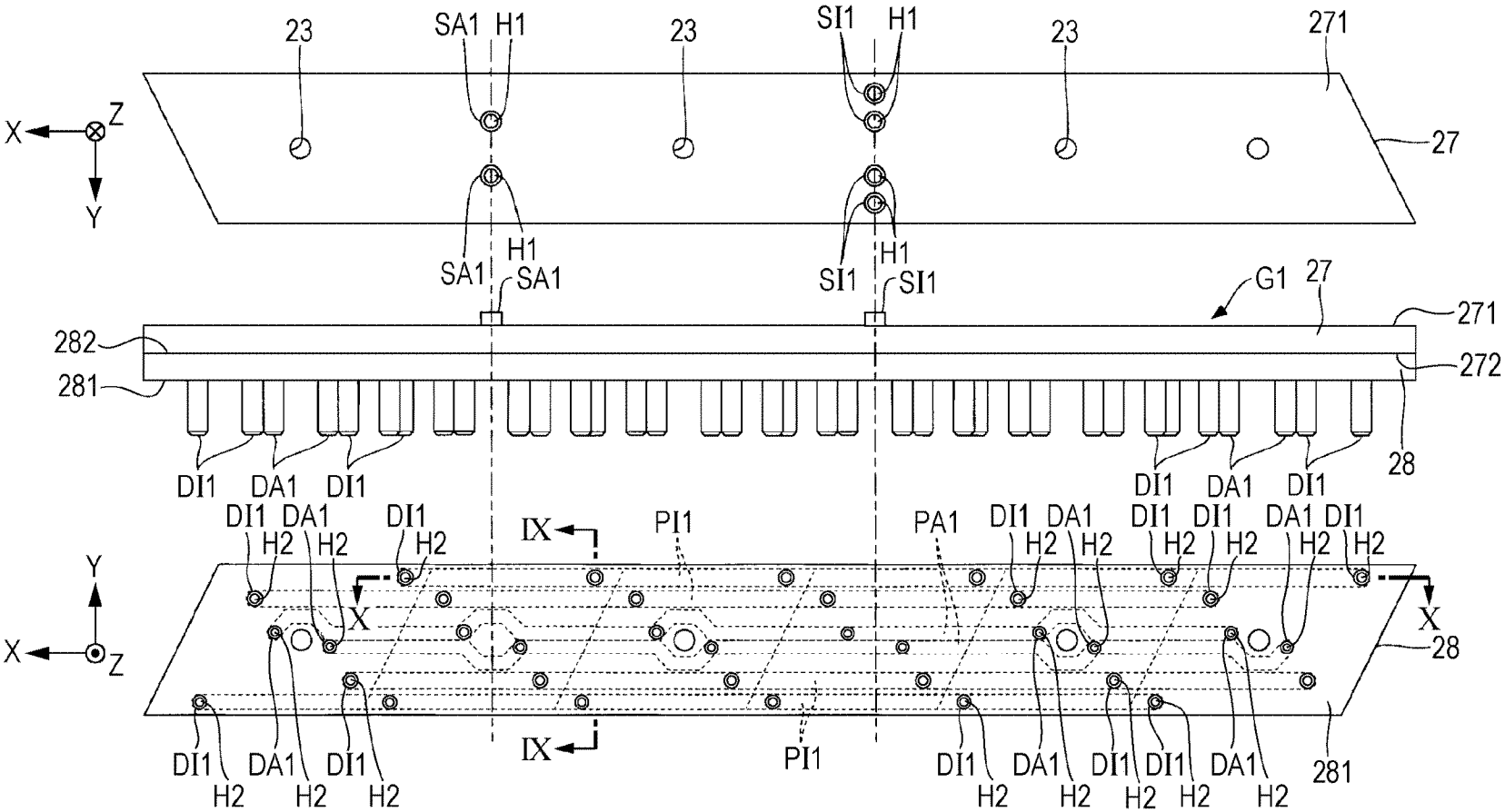
FIG. 7 is a side view and a plan view of a flow path structure illustrated in FIG. 2.

Here, a configuration of the flow path structure G1 in which the flow path of the fluid (liquid or gas) in the first embodiment will be described in more detail. FIG. 7 is a side view and a plan view of the flow path structure G1. As illustrated in FIG. 7, the flow path structure G1 is a structure having a shape of a flat plate in which a first substrate 27 and a second substrate 28 are joined to each other in a state of opposing each other. The first substrate 27 and the second substrate 28 are a flat plate material which is long in the X direction, and for example, are formed of a resin material, such as polypropylene. The first substrate 27 and the second substrate 28 are joined by the laser welding as will be described later.

The first substrate 27 is provided with a first surface 271 opposite to the second substrate 28, and a first opposing surface 272 which opposes the second substrate 28 and is opposite to the first surface 271. Similarly, the second substrate 28 is provided with a second surface 281 opposite to the first substrate 27, and a second opposing surface 282 which opposes the first substrate 27 and is opposite to the second surface 281.

In FIG. 7, a plan view of the first surface 271 and a plan view of the second surface 281 are described together. On the first surface 271 of the first substrate 27, four flow path pipes SI1 which become an inlet flow path which supplies the ink I (C, M, Y, K) of each system from the liquid container 18, and two flow path pipes SA1 which become the inlet flow path which supplies the gas, here, the air A (A1, A2), of two systems from the pump 16, are formed. Each of the flow path pipes SI1 and SA1 which become the inlet flow paths protrudes to a negative side in the Y direction from the first surface 271 of the first substrate 27.

On the second surface 281 of the second substrate 28, six flow path pipes DI1 which become outlet flow paths corresponding to the ink I of each system, and a flow path pipe DA1 which becomes two outlet flow paths corresponding to the air A of each system, are separately formed in each of six liquid ejecting units U3. Six flow path pipes DI1 which correspond to the ink I of one arbitrary system are arranged in the X direction at a substantially equivalent interval, and six flow path pipes DA1 which correspond to the air A of one arbitrary system are arranged in the X direction at a substantially equivalent interval. Each of the flow path pipes DI1 and DA1 which become the outlet flow paths protrude to a positive side in the Y direction from the second surface 281 of the second substrate 28.

As illustrated by a dotted line in FIG. 7, between the first opposing surface 272 of the first substrate 27 and the second opposing surface 282 of the second substrate 28, four flow paths PI1 of the liquid which correspond to the ink I of each system, and two flow paths PA1 of the gas which correspond to the air A of each system, are formed. Each flow path PI1 and each flow path PA1 are present in a shape of a substantially straight line along the X direction across substantially the entire region of the range in which six flow path control units U2 are arranged in a plan view. On both sides which nip two flow paths PA1 which correspond to the air A in a plan view, four flow paths PI1 which correspond to the ink I are positioned. In addition, each flow path PA1 which corresponds to the air A is bent in a plan view to detour an attaching hole 23.

Each flow path PI1 is formed to overlap one flow path pipe SI1 for supplying the ink I in a plan view, and communicates with an inlet flow path H1 formed in the flow path pipe SI1 to penetrate the first substrate 27. Similarly, each flow path PA1 is formed to overlap one flow path pipe SA1 for supplying the air A, and communicates with the inlet flow path H1 formed in the flow path pipe SA1 to penetrate the first substrate 27.

In this manner, each flow path PI1 is a flow path which communicates with the inlet flow path H1 formed in one flow path pipe SI1, and outlet flow paths H2 formed in each of six flow path pipes DI1. Each flow path PA1 is a flow path which communicates with the inlet flow path H1 formed in one flow path pipe SA1, and the outlet flow paths H2 formed in each of six flow path pipes DA1. The flow paths PI1 and PA1 accumulate the first substrate 27 and the second substrate 28 so that the first opposing surface 272 and the second opposing surface 282 come into contact with each other, and are configured by fixing the periphery of the flow path groove formed in one or both thereof. In other words, here, the flow paths PI1 and PA1 are a region surrounded by the fixing surface. The fixing surface which surrounds the flow paths PI1 and PA1 may be, for example, a welding surface by the laser welding, or an adhering surface by an adhesive, but here, a case where the fixing surface is the welding surface by the laser welding, will be described as an example.

In a case where the flow paths PI1 and PA1 are formed by performing the laser welding with respect to the first substrate 27 and the second substrate 28, one of the first substrate 27 and the second substrate 28 is configured of a light transmitting member having transmitting properties with respect to the laser light, and the other one of the first substrate 27 and the second substrate 28 is configured of a light absorbing member having absorbing properties with respect to the laser light. In addition, the laser light is radiated from the front surface of the substrate configured of the light transmitting member, and the welding is performed. In the first embodiment, a case where the first substrate 27 is configured of the light absorbing member, the second substrate 28 is configured of the light transmitting member, the laser light is radiated from the second surface 281 of the second substrate 28, and the welding is performed, is described as an example.

Meanwhile, in the flow path structure G1 of the first embodiment, on the second surface 281 of the second substrate 28 which radiates the laser light, six flow path pipes DI1 are formed to protrude from the second surface 281. Therefore, the thickness of a part of the pipe surface of the flow path pipe DI1 increases to be thicker than that of other parts only by the length (thickness) of protrusion of the flow path pipe DI1 from the second surface 281. In this configuration, if the welding surface overlaps the pipe surface of the flow path pipe DI1 in the radiation direction of the laser light, since the laser light is likely to be attenuated at a part which overlaps the pipe surface of the flow path pipe DI1, compared to other parts, there is a problem that welding unevenness due to insufficient welding is likely to be generated. When welding unevenness is generated, there is a concern that the air tightness of the flow path deteriorates.

Here, in the embodiment, as illustrated in FIG. 7, in the region of each of the flow paths PI1 and PA1 in a plan view, the pipe surface (outer circumference) of the flow path pipes DI1 and DA1 are included. According to this, in the radiation direction of the laser light, since it is possible to make the welding surface which surrounds each of the flow paths PI1 and PA1 not to overlap the pipe surface of the flow path pipes DI1 and DA1, it is possible to effectively reduce welding unevenness.

Figure 8:
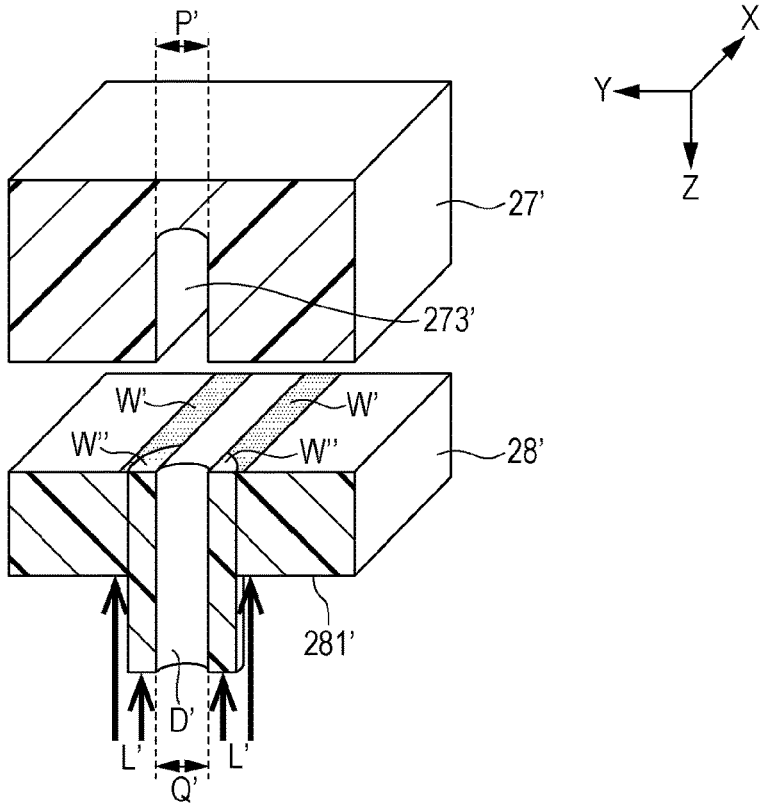
FIG. 8 is a sectional perspective view illustrating a flow path structure in a first comparative example.
Figure 9:
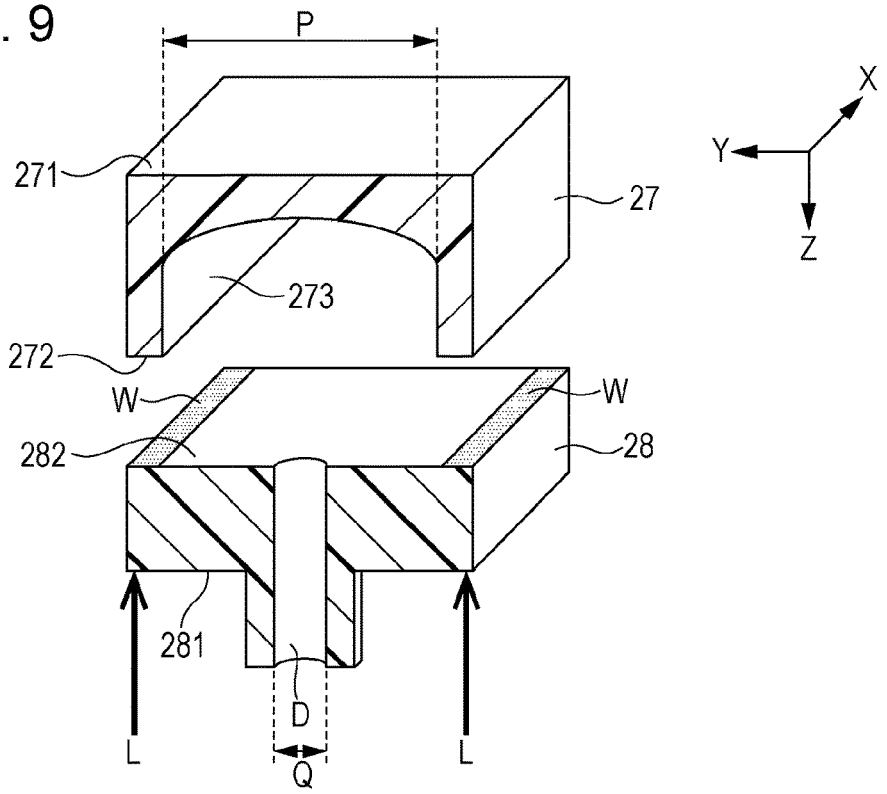
FIG. 9 is a view illustrating the flow path structure in the first embodiment, and is a sectional perspective view of the flow path structure illustrated in FIG. 7 taken along line IX-IX.

Here, a flow path structure of the flow path structure G1 of the first embodiment will be described in more detail comparing to a first comparative example. FIG. 8 is a sectional perspective view illustrating a flow path structure of the first comparative example, and illustrates a case where a welding surface W' which surrounds a first flow path P' in the radiation direction of laser light L' overlaps the pipe surface of a flow path pipe D' of a second flow path Q'. FIG. 9 is a view illustrating the flow path structure in the first embodiment, and is a sectional perspective view of a flow path structure G illustrated in FIG. 7 taken along line IX-IX. FIG. 9 illustrates a case where a welding surface W which surrounds a first flow path P in the radiation direction of laser light L does not overlap the pipe surface of a flow path pipe D of a second flow path Q which corresponds to the flow path pipes DI1 and DA1 of the outlet flow path H2. FIGS. 8 and 9 are views cut by a plane including the welding surfaces W and W' after the laser welding. In addition, the "first flow path" in the first embodiment is a flow path which is surrounded by the welding surface by the laser welding, and in which the fluid (liquid or gas) flows. At this point, the flow path PI1 of each liquid and the flow path PA1 of each gas correspond to the "first flow path" of the first embodiment, and the outlet flow path H2 corresponds to the "second flow path". Meanwhile, in the second embodiment which will be described later, a flow path configuration having improved discharge performance of the bubbles included in the liquid which flows in the flow path, is described as an example. Therefore, each flow path PI1 of the liquid corresponds to the "first flow path" in the second embodiment.

In FIG. 8, the flow path pipe D' which forms the second flow path Q' is formed to protrude from a second surface 281' of a second substrate 28', on the positive side in the Z direction, and the periphery of a flow path groove 273' formed on a first substrate 27' is welded by the laser light L', and accordingly, the first flow path P' surrounded by the welding surface W' is formed. In FIG. 9, the flow path pipe D which forms the second flow path Q is formed to protrude from the second surface 281 of the second substrate 28 on the positive side in the Z direction, the periphery of a flow path groove 273 formed on the first substrate 27 is welded by the laser light L, and accordingly, the first flow path P surrounded by the welding surface W is formed.

In a configuration of the first example of FIG. 8, in a plan view from the radiation direction of the laser light L', that is, the direction (negative side in the Z direction) orthogonal to the welding surface W', the pipe surface of the flow path pipe D' is disposed exceeding the region of the first flow path P'. In the configuration of the first comparative example, the welding surface W' which surrounds the first flow path P' in the radiation direction of the laser light L' overlaps the pipe surface of the flow path pipe D' of the second flow path Q'. The thickness of a part of the pipe surface of the flow path pipe D' increases to be thicker than that of the thickness of the second surface 281' only by the length (thickness) of protrusion of the flow path pipe D from the second surface 281'. Therefore, as illustrated in FIG. 8, in the radiation direction of the laser light, when a welding surface W" which overlaps the pipe surface of the flow path pipe DI1 on the welding surface W' is present, since laser light La' radiated to the welding surface W" is likely to be attenuated compared to the laser light L of other parts, welding unevenness due to the insufficient welding is likely to be generated.

Meanwhile, in the configuration of the first embodiment illustrated in FIG. 9, in a plan view from the radiation direction of the laser light L, that is, the direction (negative side in the Z direction) orthogonal to the welding surface W, the pipe surface of the flow path pipe D is disposed in the region of the first flow path P. Accordingly, it is possible to make the welding surface W which surrounds the first flow path P in the radiation direction of the laser light L not to overlap the pipe surface of the flow path pipe D of the second flow path Q. Therefore, since the attenuation of the laser light L due to the difference in the thickness is not generated, it is possible to sufficiently perform the welding, and to effectively reduce welding unevenness. Accordingly, it is possible to form the first flow path P having high air tightness.

Figure 10:
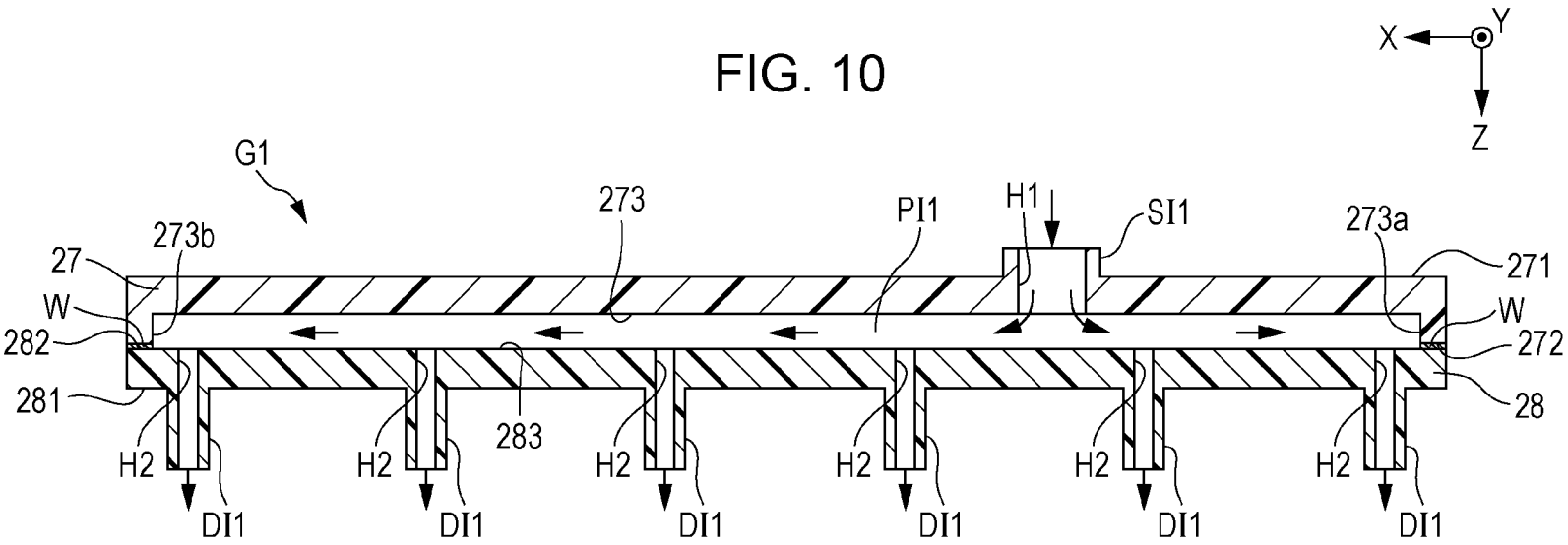
FIG. 10 is a partial sectional view of the flow path structure taken along line X-X illustrated in FIG. 7.
Figure 11:
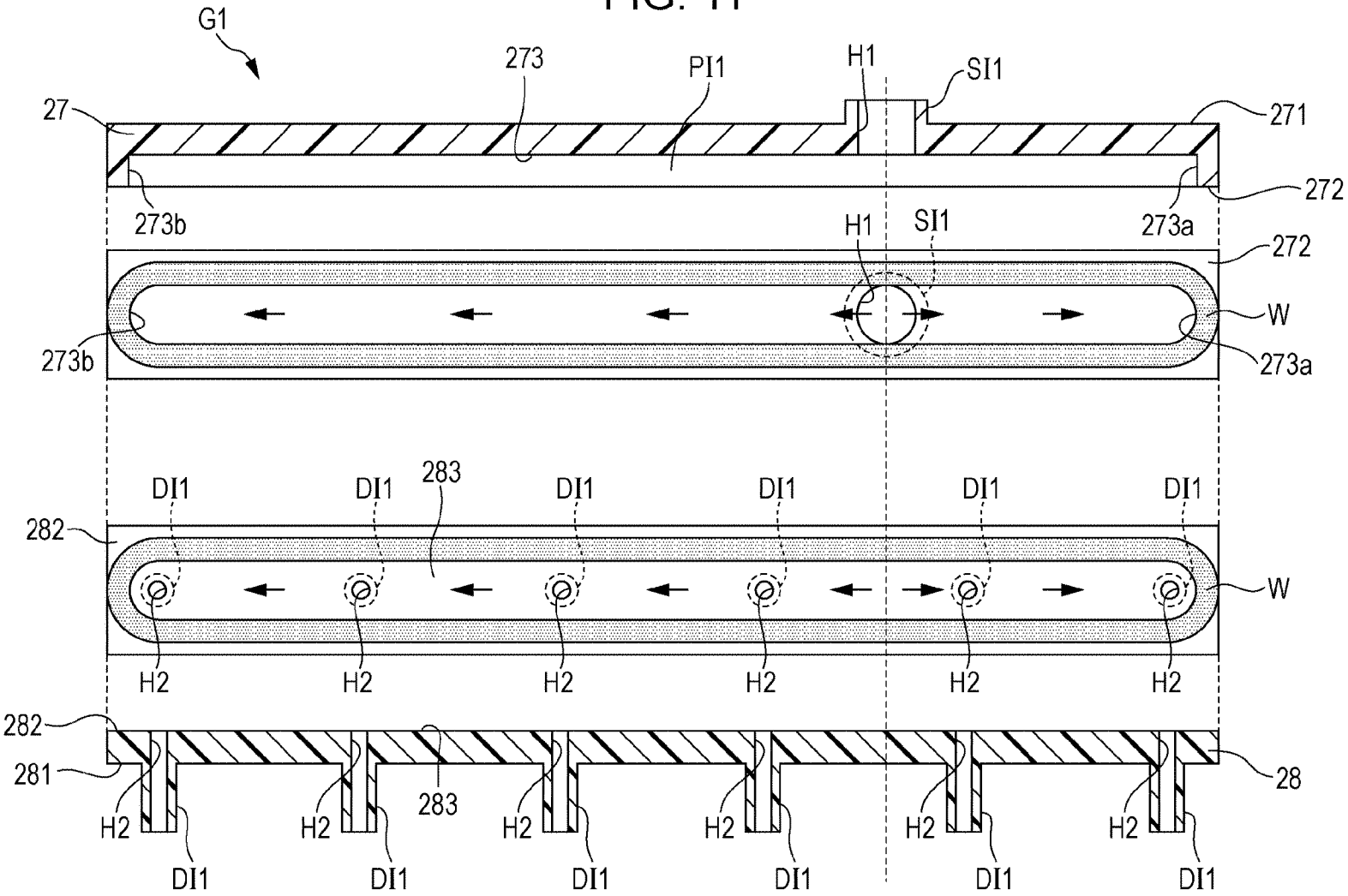
FIG. 11 is a side view and a plan view of a part of the flow path structure illustrated in FIG. 10.

The flow path structure of the first embodiment will be specifically described in more detail by using the flow path PI1 of the liquid as an example. The flow path PI1 of the liquid in the first embodiment has four systems, and flow path structures of a part of the liquid path structure G1 including each flow path PI1 are configured to be similar to each other. Here, a flow path structure of a part including the flow path PI1 of one arbitrary system will be taken and described. FIG. 10 is a partial sectional view of the flow path structure G1 taken along line X-X illustrated in FIG. 7. FIG. 11 is a side view and a plan view in a case where the first substrate 27 and the second substrate 28 which configure a part of the flow path structure G1 illustrated in FIG. 10 are exploded.

As illustrated in FIGS. 10 and 11, in the first opposing surface 272 of the first substrate 27, the flow path groove 273 which extends in the X direction along the first opposing surface 272, and the inlet flow path H1 which communicates with the flow path groove 273, are formed. The flow path groove 273 is a groove having a substantially rectangular section which configures the flow path PI1 that corresponds to the first flow path, and the inlet flow path H1 is a through-hole which is formed in the flow path pipe SI1 that protrudes from the first surface 271 of the first substrate 27. The flow path groove 273 is formed across two end portions 273*a* and 273*b* which are separated from each other in the X direction of the flow path PI1, and the inlet flow path H1 is disposed between the end portions 273*a* and 273*b*.

On the second opposing surface 282 of the second substrate 28, six outlet flow paths H2 which correspond to the second flow path are formed in the direction (Z direction) perpendicular to the second opposing surface 282. The outlet flow path H2 is a through-hole which is formed in the flow path pipe DI1 that protrudes from the second surface 281 of the second substrate 28. Six outlet flow paths H2 are disposed across both sides of the inlet flow path H1 in a plan view from the Z direction. The inlet flow path H1 is disposed to be closer to one end portion 273*a* than the center between one end portion 273*a* and the other end portion 273*b*. Therefore, the number of outlet flow paths H2 disposed between the inlet flow path H1 and each of the end portions 273*a* and 273*b*, varies.

Specifically, the outlet flow paths H2 are respectively disposed one by one in both of the end portions 273*a* and 273*b* of the flow path groove 273. In the middle (more right side than the inlet flow path H1 in FIGS. 10 and 11) of the inlet flow path H1 and one end portion 273*a*, one outlet flow path H2 is disposed, and in the middle (more left side than the inlet flow path H1 of FIGS. 10 and 11) of the inlet flow path H1 and the other end portion 273*b*, three outlet flow paths H2 are disposed.

According to the flow path structure, the ink which flows from the inlet flow path H1 branches to the negative side and the positive side in the X direction, and flows toward both of the end portions 273*a* and 273*b* of the flow path PI1. In other words, in the flow path PI1, a flow of the ink toward one end portion 273*a* further on the downstream side from the inlet flow path H1 on the upstream side, and a flow of the ink toward the other end portion 273*a* on the downstream side from the inlet flow path H1 on the upstream side in the orientation reverse thereto, are generated.

The ink which flows toward one end portion 273*a* of the flow path PI1 branches and flows out to each of the outlet flow path H2 of the end portion 273*a* and one outlet flow path H2 between the end portion 273*a* and the inlet flow path H1. The ink which flows toward the other end portion 273*b* of the flow path PI1 branches and flows out to each of the outlet flow path H2 of the end portion 273*b* and three outlet flow paths H2 between the end portion 273*b* and the inlet flow path H1. In addition, the number and the disposition of the inlet flow path H1 and the outlet flow path H2 are not limited to the description above.

The first substrate 27 and the second substrate 28 configured in this manner, are accumulated so that each of the first opposing surface 272 and the second opposing surface 282 come into contact with each other, and the periphery of the flow path groove 273 is welded by the laser light radiated toward the second surface 281 of the second substrate 28. Accordingly, the flow path (first flow path) PI1 is configured of a space which is configured of the inner wall surface of the flow path groove 273 of the first substrate 27 and the wall surface opposing the flow path groove 273 of the second substrate 28.

The welding surface W formed in this manner has, for example, a shape of an annular belt illustrated by halftone dot meshing in a plan view of the first substrate 27 and the second substrate 28 in FIG. 9. The flow path PI1 is a region (region on the inner side of an inner circumferential edge of the welding surface W having a shape of an annular belt) surrounded by the welding surface W. As illustrated in a plan view of the second substrate 28 of FIG. 11, all of six flow path pipes DI1 including the pipe surfaces thereof are disposed to be included in the region of the flow path PI1. Accordingly, it is possible to make the welding surface W which surrounds the flow path PI1 in the radiation direction of the laser light not to overlap the pipe surface of the flow path pipe DI1. Therefore, since the attenuation of the laser light L due to the difference in the thickness is not generated as described above, it is possible to effectively reduce welding unevenness. In addition, a case where the flow path pipe DI1 of FIGS. 10 and 11 protrudes in the direction orthogonal to the welding surface W is illustrated as an example, but the flow path pipe DI1 may protrude in the direction diagonal to the welding surface W.

Regarding the "flow path surrounded by the welding surface" here, when considering a case where there is an error in flatness of each of the first substrate 27 configured of the light absorbing member and the second substrate 28 configured of the light transmitting member, even when the entire melted surface of the light absorbing member does not abut against the light transmitting member, both are fixed as surfaces, and as a result, the flow path PI1 may be formed. Therefore, in a case where a void of both of the surfaces is sealed, an interval between an opposing surface of the light absorbing member and an opposing surface of the light transmitting member is equal to or less than 0.3 mm, and a case where the light absorbing member of the part is melted is also included in the "welding surface".

In addition, whether or not the void between the light absorbing member and the light transmitting member is sealed (air tightness) is measured, for example, by the following method. The air of +50 kPa is sent by blocking the entire other flow path which communicates with the flow pat of the measurement target, and a pressure change of the flow path of the measurement target is measured. In this case, when the pressure change in 5 seconds after the air is sent is equal to or less than 1 kPa, the flow path of the measurement target is sealed.

In addition, according to the flow path structure illustrated in FIG. 10, since the inlet flow path H1 of the flow path PI1 is between the outlet flow paths H2 (second flow paths) of both of the end portions 273*a* and 273*b* of the flow path PI1, the ink which flows from the inlet flow path H1 branches, and is likely to flow not only to the outlet flow path H2 of one end portion 273*a* but also the outlet flow path H2 of the other end portion 273*b*. According to this, compared to a case where the inlet flow path H1 is not present between both of the end portions 273*a* and 273*b*, since it is possible to suppress the stagnation of the ink in both of the end portions 273*a* and 273*b* of the flow path PI1, the bubbles which stay in the stagnation of the ink are likely to be discharged. Accordingly, while suppressing the stagnation in both of the end portions 273*a* and 273*b* of the flow path PI1, it is possible to reduce welding unevenness of the laser welding.

Manufacturing Method of Flow Path Structure

Figure 12:
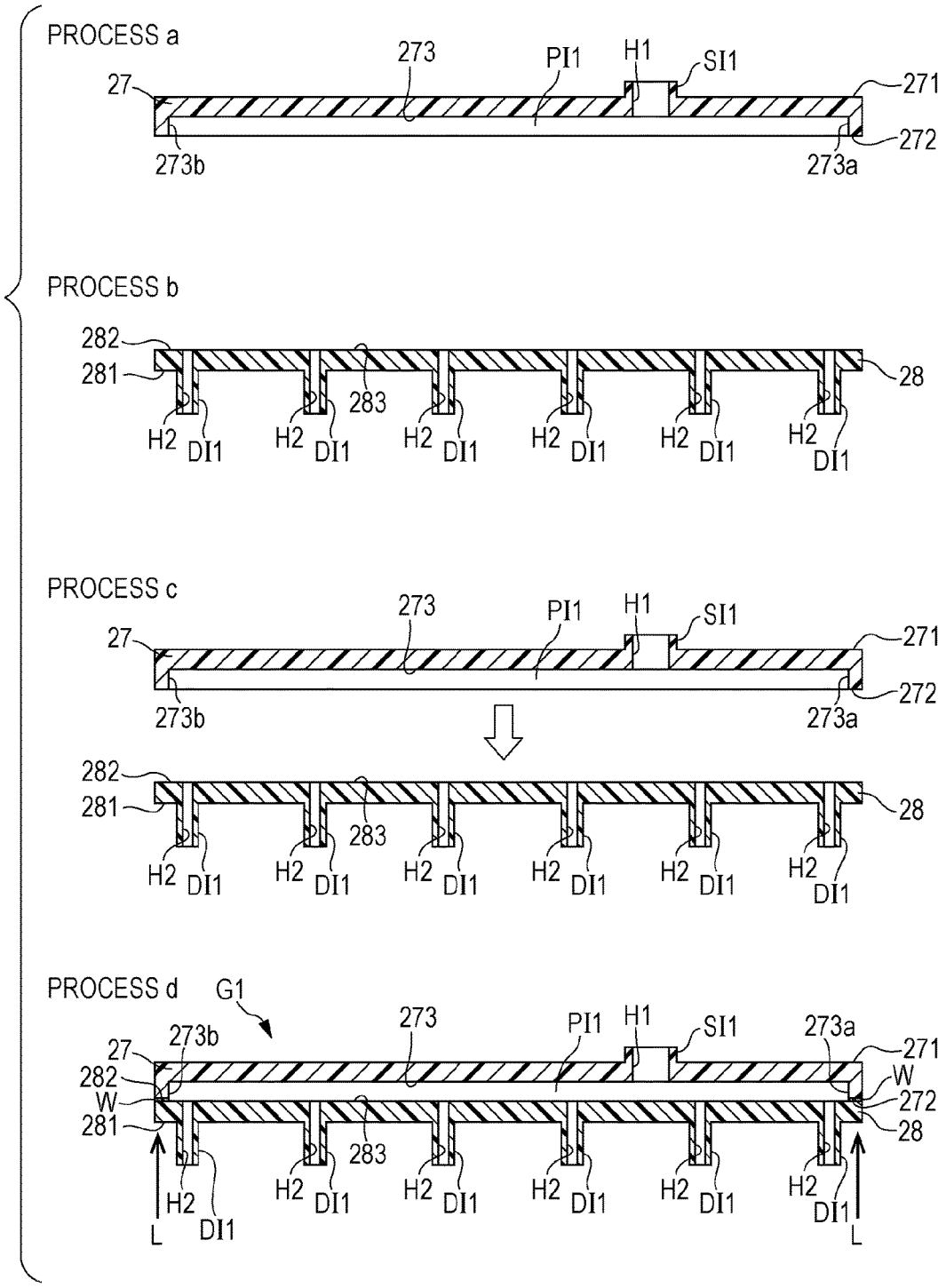
FIG. 12 is a process view illustrating a manufacturing method of the flow path structure in the first embodiment.

Next, a manufacturing method of the flow path structure G1 will be described. FIG. 12 is a process view illustrating the manufacturing method of the flow path structure G1. Here, the manufacturing method of the flow path structure G1 will be described by using a partial sectional view of the flow path structure G1 taken along line X-X illustrated in FIG. 7. First, in a process a of FIG. 12, the first substrate 27 is manufactured by a thermoplastic resin which absorbs the laser light. As the thermoplastic resin having light absorbing properties, a material which is made by mixing a predetermined coloring agent, such as carbon black, dye, or pigment, into polyamide (PA) or the like, can be employed.

In the first surface 271 of the first substrate 27, the flow path pipe SI1 which protrudes from the first surface 271 is formed, and a through-hole which configures the inlet flow path (third flow path) H1 is formed in the flow path pipe SI1. On the first opposing surface 272 of the first substrate 27, the flow path groove 273 which configures the flow path (first flow path) PI1 is formed. In this case, in the first surface 271 of the first substrate 27, the flow path pipes SI1 and SA1 of another system and the inlet flow path H1 are also formed, and in the first opposing surface 272 of the first substrate 27, the flow path groove 273 which configures the flow paths PI1 and PA1 of another system is also formed. The first substrate 27 may be manufactured by an integrated mold, or may be manufactured by processing a flat plate material.

Next, in a process b of FIG. 12, the second substrate 28 is manufactured by the thermoplastic resin which penetrates the laser light. Examples of the thermoplastic resin having the light transmitting properties include polyamide (PA), polyethylene (PE), polypropylene (PP), polyethylene terephthalate (PET), polystyrene (PS), styrene acrylonitrile copolymer, an ABS resin, an acrylic resin (PMMA), polycarbonate (PC), and polybutylene terephthalate (PBT). In addition, as necessary, a material which is made by adding reinforcing fiber, such as glass fiber or carbon fiber, or a coloring material, as necessary, may be used. On the second surface 281 of the second substrate 28, six flow path pipes DI1 which protrude from the second surface 281 are formed, and the outlet flow path (second flow path) H2 through-hole which passes through the inside of each flow path pipe DI1 and penetrates from the second surface 281 to the second opposing surface 282, is formed. At this time, on the second substrate 28, the flow path pipes DI1 and DA1 of another system and the outlet flow path H2 through-hole are also formed. The second substrate 28 may be manufactured by an integrated mold, or may be manufactured by processing a flat plate material.

Next, in a process c of FIG. 12, the first substrate 27 and the second substrate 28 are accumulated so that each of the first opposing surface 272 and the second opposing surface 282 comes into contact with each other, and in a process d of FIG. 12, the laser light L is radiated from the second surface 281 side of the second substrate 28. Then, the laser light L penetrates the second substrate 28 made of the light transmitting member, and is absorbed by the first substrate 27 made of the light absorbing member. At this time, the dye or pigment included in the light absorbing member generates the heat, the resin is melted, and at this time, the generated heat is transferred to the light absorbing member. The light transmitting member is melted by the transferred heat, and the welding surface W is formed. In addition, the welding due to the laser light L may be performed only with respect to a part to be the welding surface W, or may be integrally performed with respect to a part to be the welding surface W and a part to be the flow path.

In addition, the type of the laser light L is used being appropriately selected according to the absorption spectrum or the plate thickness (transmission length) of the material of the second substrate 28 which makes the laser light transmit. Specifically, for example, the laser light, such as glass: neodymium$^{3+}$ laser, YAG:neodymium$^{3+}$ laser, ruby laser, helium neon laser, Krypton laser, argon laser, $H_2$ laser, $N_2$ laser, or semiconductor laser, can be employed.

By the laser light L, the flow path (first flow path) PI1 surrounded by the welding surface W is formed by welding the periphery of the flow path groove 273. At this time, the flow path PI1 and the flow path PA1 of another system are also similarly formed. In this manner, the flow path structure G1 having the flow path structure illustrated in FIGS. 10 and 11 are formed. As described above, in the flow path structure G1 of the first embodiment, the pipe surface (outer circumference) of the flow path pipe DI1 is included in the region of each flow path PI1, and the pipe surface (outer circumference) of the flow path pipe DA1 is included in the region of each flow path PA1. Therefore, the welding surface W which surrounds each flow path PI1 does not overlap the pipe surface of the flow path pipe DI1 in the radiation direction when the laser light L is radiated, the welding surface W which surrounds each flow path PA1 does not overlap the pipe surface of the flow path pipe DA1, and thus, it is possible to effectively reduce welding unevenness of each welding surface W. Accordingly, it is possible to improve the air tightness of the flow path pipe DI1 formed to be surrounded by the welding surface W.

In addition, the radiation direction of the laser light L may be inclined with respect to the welding surface W, but by making the direction orthogonal to the welding surface W as illustrated in a process d of FIG. 12, it is possible to make the laser light L penetrate the light transmitting member having the same thickness across the entire welding surface W without considering the influence of attenuation or refraction. In addition, it is preferable that the angle of the laser light L in the radiation direction with respect to the welding surface W is constant across the entire welding surface W. According to this, compared to a case where the radiation angle of the laser light L changes, the laser welding is likely to be performed. In addition, the above-described light absorbing member and the light transmitting member are not limited to the member which absorbs (or transmits) the laser light L 100%. A light absorbing ratio (or light transmitting ratio) with respect to a wavelength of at least one laser light L beam of the light absorbing member and the light transmitting member may be different, and the light transmitting member may be more likely to transmit the laser light L than the light absorbing member. Therefore, the light absorbing ratio (or light transmitting ratio) of the light absorbing member and the light transmitting light may less than 100%.

In addition, in the flow path structure illustrated in FIG. 10, the flow path pipe SI1 of the inlet flow path H1 functions as the inlet flow path H1 of the flow path PI1, but it is possible to consider the flow path pipe SI1 as a flow path pipe of the third flow path which protrudes on a side opposite to the flow path pipe DI1 of the outlet flow path H2 which serves as the second flow path with respect to the welding surface W of the flow path PI1 which serves as the first flow path. The third flow path is formed to protrude on a side opposite to the flow path pipe in which the second flow path is formed with respect to the welding surface W, that is, on a side opposite to the side which radiates the laser light. Therefore, as the flow path exceeds the region of the first flow path formed to be surrounded by the welding surface W, without enlarging the sectional area of the flow path pipe of the third flow path, it is possible to reduce welding unevenness without influencing the laser welding.

Therefore, in the first embodiment, in a plan view from the positive side in the Z direction as illustrated in FIG. 11, the outer circumference of the flow path pipe SI1 is enlarged to the extent of exceeding the region of the flow path PI1 which serves as the first flow path formed to be surrounded by the welding surface W, and the sectional area of the inlet flow path H1 of the flow path pipe SI1 is enlarged to be greater than the sectional area of the flow path pipe DI1 of the outlet flow path H2. By enlarging the outer circumference of the flow path pipe SI1, it is possible to further enlarge the sectional area of the inlet flow path H1. In this manner, by enlarging the sectional area of the inlet flow path H1, it is possible to reduce the pressure loss in the flow path PI1. In particular, since the pressure loss is likely to be generated in a case where the plurality of outlet flow paths H2 which communicate with the flow path PI1 are present as illustrated in FIG. 10, an effect that the reduction of the pressure loss is possible, is large. Accordingly, while reducing the pressure loss, it is possible to reduce welding unevenness of the laser welding.

In addition, as the flow path pipe formed on the first surface 271 of the first substrate 27, another flow path pipe which configures the third flow path that communicates with the flow path PI1, may further be provided. The third flow path in this case may be the inlet flow path of the flow path PI1, and may be the outlet flow path of the flow path PI1. Since the sectional area of the third flow path can be enlarged to be greater than that of the second flow path as described above, in a case where the plurality of third flow paths are provided, when the number of third flow paths increases with respect to the number of second flow paths, it is possible to influence the flow of the second flow path. Therefore, it is preferable that the number of third flow paths is smaller than the number of second flow paths.

Figure 13:
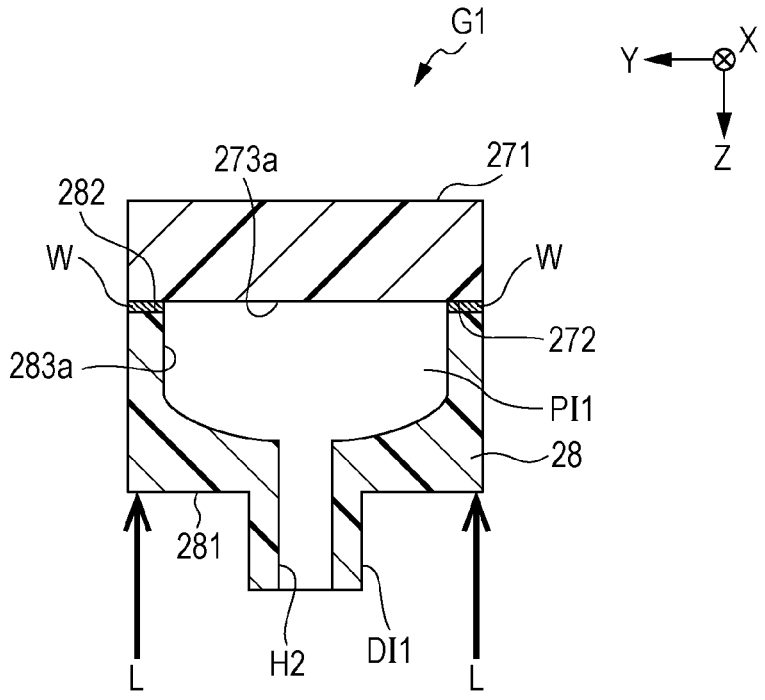
FIG. 13 is a partial sectional view of the flow path structure according to a modification example of the first embodiment.

In addition, in the flow path structure illustrated in FIG. 10, a case where the flow path groove 273 of the flow path PI1 is formed on the first substrate 27 side, is described as an example, but the invention is not limited thereto. For example, as illustrated in FIG. 13, a flow path groove 283*a* may be formed on the second opposing surface 282 on the second substrate 28 side. The flow path structure illustrated in FIG. 13 is formed by accumulating the first substrate 27 and the second substrate 28, and by joining the periphery of the flow path groove 283*a* by the laser welding. Accordingly, the flow path PI1 is formed by the space formed on the inner wall of the flow path groove 283*a* of the second substrate 28, and on the wall surface of the first substrate 27 which opposes the flow path groove 283*a*. Even in this case, as illustrated in FIG. 13, in a plan view, as the pipe surface of the flow path pipe DI1 is included in the region of the flow path PI1, it is possible to make the welding surface W which surrounds the flow path PI1 not to overlap the pipe surface of the flow path pipe DI1. Therefore, it is possible to effectively reduce welding unevenness due to the laser welding.

In addition, in the first embodiment, a sectional shape when the flow path PI1 is viewed in a sectional view on the section orthogonal to the flow direction of the flow path PI1, forms a curved surface on which the flow path width narrows when approaching the first surface 271, on the first surface 271 side of the first substrate 27, as illustrated in FIG. 9. The sectional shape of the flow path PI1 is not limited thereto, and may be rectangular, but forming the curved surface as illustrated in FIG. 9 makes the stagnation of the angle portion of the flow path PI1 more unlikely to be generated. In addition, as illustrated in FIG. 13, on the contrary to FIG. 9, the flow path section of the flow path PI1 may form a curved surface on which the flow path width narrows when approaching the second surface 281, on the second surface 281 side of the second substrate 28.

Figure 14:
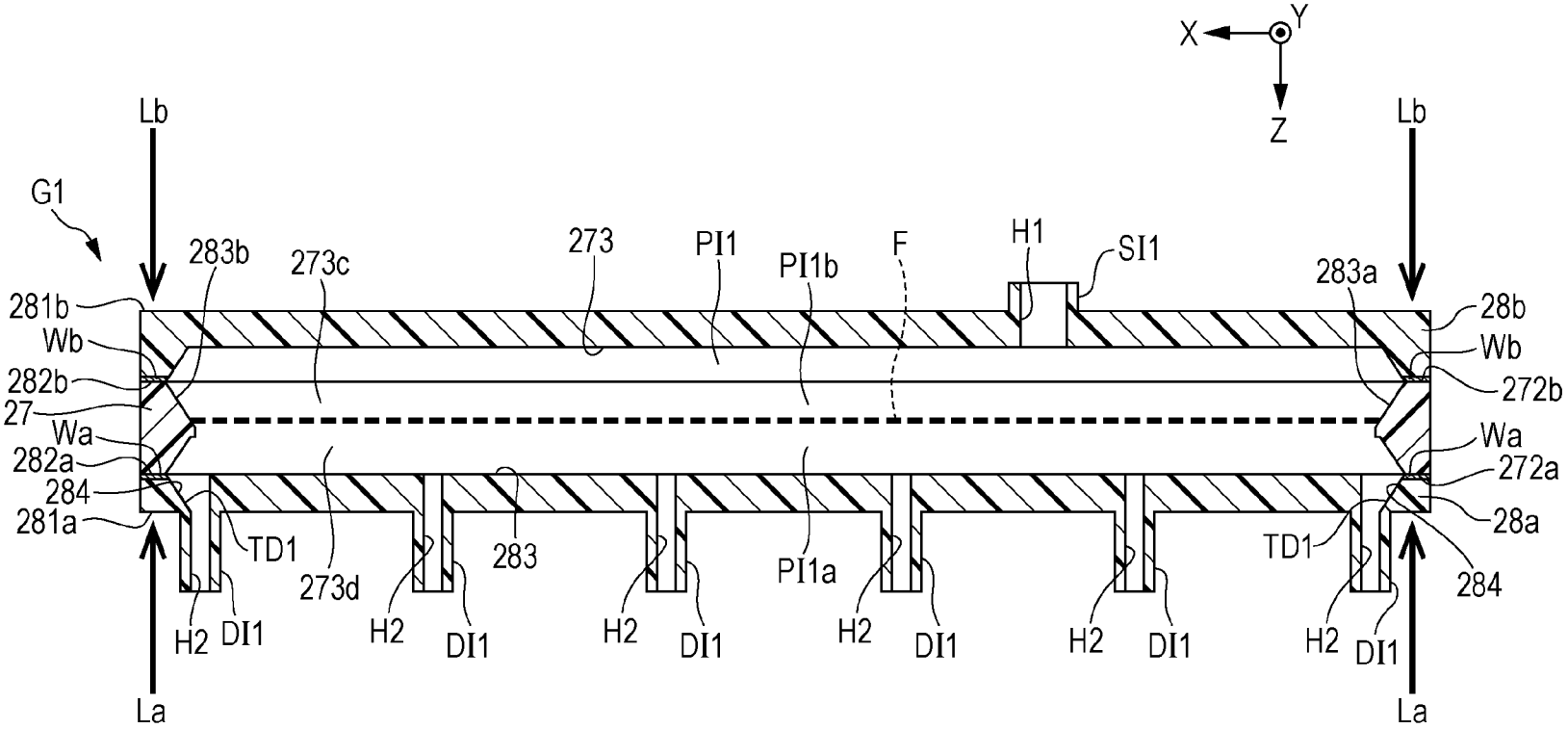
FIG. 14 is a partial sectional view of the flow path structure according to another modification example of the first embodiment.

In addition, the first embodiment employs the flow path structure G1 having two-layered structure in which two substrates (the first substrate 27 and the second substrate 28) are joined as illustrated in FIG. 10, as an example, but the invention is not limited thereto, and the flow path structure G1 having three-layered structure in which three substrates are joined, may be employed. For example, the flow path structure G1 having three-layered structure illustrated in FIG. 14 is joined to the first substrate 27 made of one light absorbing member, and is provided with second substrates 28*a* and 28*b* made of two light transmitting members having transmitting properties with respect to the laser light. The first substrate 27 is accumulated to be nipped between two second substrates 28*a* and 28*b*.

The first substrate 27 is provided with an opposing surface 272*a* which opposes the second substrate 28*a*, and an opposing surface 272*b* which is a surface opposite to the opposing surface 272*a* and opposes the second substrate 28*b*. The second substrate 28*a* is provided with an opposing surface 282*a* which opposes the first substrate 27, and a second surface 281*a* opposite to the opposing surface 282*a*. The second substrate 28*b* is provided with an opposing surface 282*b* which opposes the first substrate 27, and a first surface 281*b* opposite to the opposing surface 282*b*.

The flow path PI1 is divided into a first flow path chamber PI1*a* and a second flow path chamber PI1*b*, by a filter F provided in the first substrate 27. The first flow path chamber PI1*a* is a space surrounded by an inner wall of a first flow path hole 273*c* formed on the opposing surface 272*a* of the first substrate 27, and a wall surface of the second substrate 28*a* which opposes the first flow path hole 273*c*. The second flow path chamber PI1*b* is a space surrounded by an inner wall of a second flow path hole 273*d* formed on the opposing surface 272*b* of the first substrate 27, and an inner wall of a flow path groove 283*b* formed on the opposing surface 282*b* of the second substrate 28*b*.

The flow path pipe SI1 of one inlet flow path H1 is formed to protrude from the first surface 281*b* of the second substrate 28*b*, and the flow path pipes DI1 of six outlet flow paths H2 are formed to protrude from the second surface 281*a* of the second substrate 28*a*. Each of the outlet flow paths H2 communicate with the first flow path chamber PI1*a* of the flow path PI1. The inlet flow path H1 communicates with the second flow path chamber PI1*b* of the flow path PI1. According to the flow path structure, the ink which flows from the inlet flow path H1 flows in the second flow path chamber PI1*b* of the flow path PI1 via the filter F from the first flow path chamber PI1*a* of the flow path PI1, and flows out of each outlet flow path H2. The filter F captures the bubbles or the foreign substances from the ink supplied to the inlet flow path H1. The ink from which the bubbles or the foreign substances are removed by the passage of the filter F, flows out of each outlet flow path H2.

The first flow path chamber PI1*a* of the flow path PI1 is formed to be surrounded by a welding surface Wa by the laser welding between the opposing surface 282*a* of the second substrate 28*a* and the opposing surface 272*a* of the first substrate 27. The second flow path chamber PI1*b* of the flow path PI1 is formed to be surrounded by a welding surface Wb by the laser welding between the opposing surface 282*b* of the second substrate 28*b* and the opposing surface 272*b* of the first substrate 27.

In this manner, since the first substrate 27 made of the light absorbing member is accumulated to be nipped between two second substrates 28*a* and 28*b* made of the light transmitting members in the flow path structure G1 illustrated in FIG. 14, the flow path PI1 can be formed by the laser welding from both sides of the second substrates 28*a* and 28*b*. Specifically, in a state where the first substrate 27 is accumulated to be nipped between two second substrates 28*a* and 28*b*, laser light La is radiated from the second surface 281*a* of the second substrate 28*a*, and laser light Lb is radiated from the first surface 281*b* of the second substrate 28*b*. Accordingly, the first flow path chamber PI1*a* of the flow path PI1 is formed by the welding surface Wa welded by the laser light La, and the second flow path chamber PI1*b* of the flow path PI1 is formed by the welding surface Wb welded by the laser light Lb.

In the flow path structure G1 illustrated in FIG. 14, since the flow path PI1 is formed by the laser welding from both sides of the second substrates 28*a* and 28*b*, all of the end surfaces (outer circumferences) of each of the flow path pipe DI1 and the flow path pipe SI1 are included in the region of the flow path PI1 in a plan view from the Z direction, not only with respect to the flow path pipe DI1 which forms the outlet flow path H2 but also with respect to the flow path pipe SI1 which forms the inlet flow path H1. At this point, in the configuration illustrated in FIG. 14, not only the flow path pipe DI1 but also the flow path pipe SI1 corresponds to the flow path pipe which forms the second flow path. Therefore, it is possible to make the end surface of each of the flow path pipe DI1 and the flow path pipe SI1 not to overlap the welding surfaces Wa and Wb in the radiation direction of both of the laser light La and laser light Lb. Accordingly, it is possible to reduce welding unevenness of the welding surfaces Wa and Wb.

However, the invention is not limited thereto. The first substrate 27 may be joined to one of the second substrates 28*a* and 28*b* by the laser welding, and the first substrate 27 may be joined to the other one of the second substrates 28*a* and 28*b* by an adhesive or the like. According to this, it is possible to provide a flow path pipe in which the third flow path that exceeds the region of the flow path PI1 which is the first flow path is formed, on one of the second substrates 28*a* and 28*b* to which the laser welding is not performed. For example, similar to the flow path pipe SI1 illustrated in FIG. 11, the flow path pipe SI1 illustrated in FIG. 14 may be enlarged to the extent of exceeding the region of the flow path PI1, and the sectional area of the inlet flow path H1 of the flow path pipe SI1 may be enlarged to be greater than the sectional area of the flow path pipe DI1 of the outlet flow path H2. Accordingly, it is possible to reduce the pressure loss in the flow path PI1. The flow path pipe SI1 corresponds to the flow path pipe in which the third flow path is formed. In this case, as the second substrate 28*a* on which the flow path pipe DI1 of the outlet flow path H2 is formed and the first substrate 27 are joined by the laser welding, and the second substrate 28*b* on which the flow path pipe SI1 having a large sectional area is formed and the first substrate 27 are joined by an adhesive or the like, it is possible to reduce welding unevenness due to the laser welding.

In addition, since the filter F interposed between two second substrates 28*a* and 28*b* is provided on the first substrate 27 nipped between the second substrates 28*a* and 28*b*, compared to a case where the filter F is provided on any of two second substrates 28*a* and 28*b*, it is not necessary to dispose the filter F not to overlap in the radiation direction of the laser light. Therefore, it is possible to improve the degree of freedom of the design, such as the disposition or the size of the filter F.

In addition, as the inclined surface is formed on the wall surfaces of the end portions 273*a* and 273*b* of the flow path PI1, and an enlarged diameter portion 284 having an inclined surface in a tapered shape which widens to the downstream side is formed in the outlet flow path H2 of the end portions 273*a* and 273*b*, it is possible to suppress the stagnation of the ink in the end portions 273*a* and 273*b* of the flow path PI1, and to improve the discharge performance of the bubbles which stay at the stagnation part. As illustrated in FIG. 14, on the wall surfaces of the end portions 273*a* and 273*b*, the plurality of inclined surfaces may be formed and the inclined surfaces may be joined, or one inclined surface may be formed. Each of the inclined surfaces of the enlarged diameter portion 284 is configured to be joined to the inclined surfaces of the wall surfaces of the end portions 273*a* and 273*b* by the welding surface Wa. A shape of the end portions 273*a* and 273*b* and the enlarged diameter portion 284 of the flow path PI1 will be described in more detail by a second embodiment.

Flow Path Structure in Second Embodiment

Next, the flow path structure G1 in the second embodiment will be described. In the first embodiment, the flow path structure G1 which can improve the air tightness of the first flow path formed to be surrounded by the welding surface by reducing welding unevenness, in the laser welding with respect to the substrate on which the flow path pipe is projected, will be described. In the second embodiment, the flow path structure G1 which can improve the bubbles discharge performance by suppressing the stagnation of the ink at the branch point, in the flow path structure provided with the second flow path that branches from the first flow path, in the first flow path in which the liquid flows, will be described.

Figure 15:
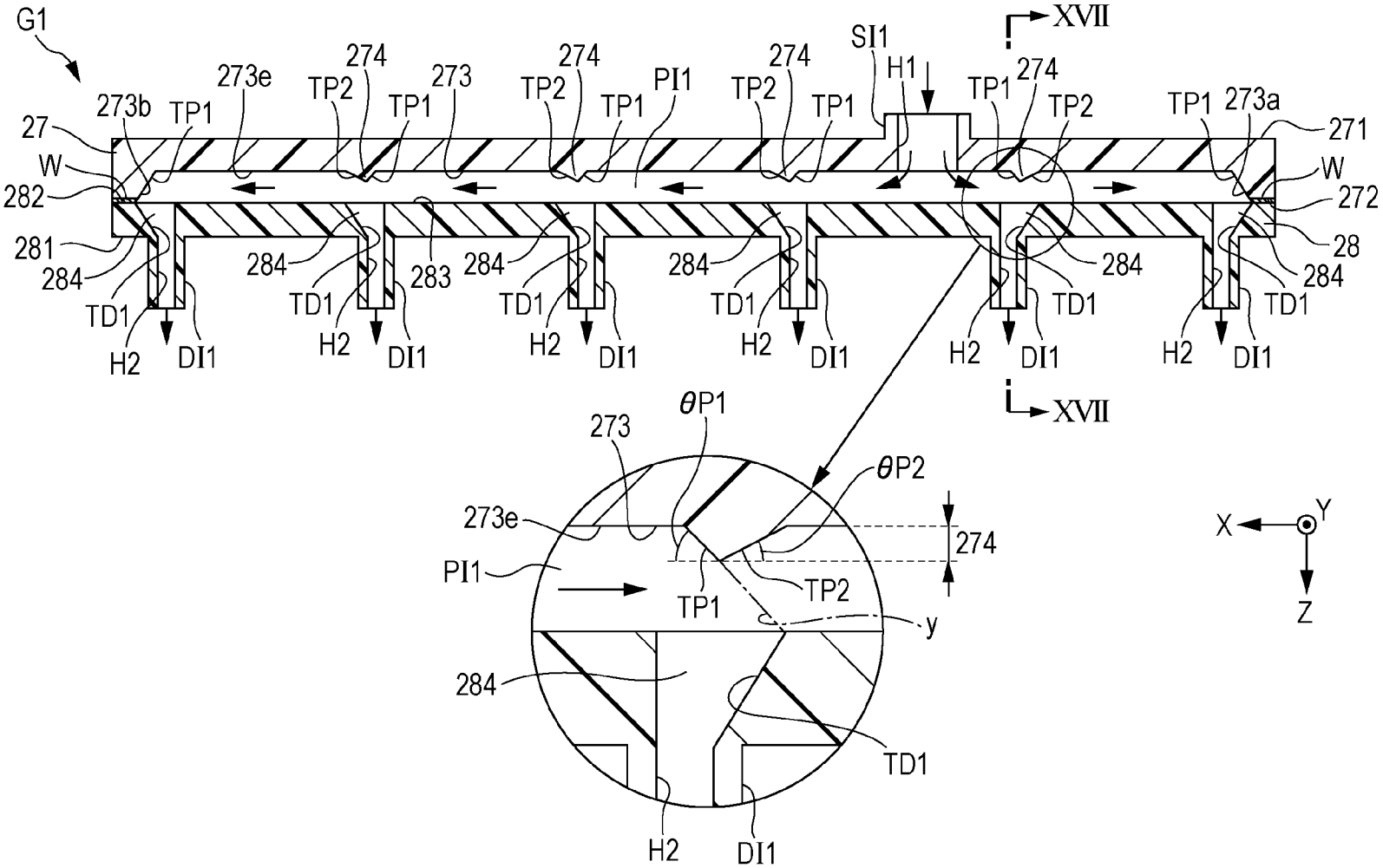
FIG. 15 is a partial sectional view illustrating a configuration of the flow path structure according to a second embodiment of the invention.
Figure 16:
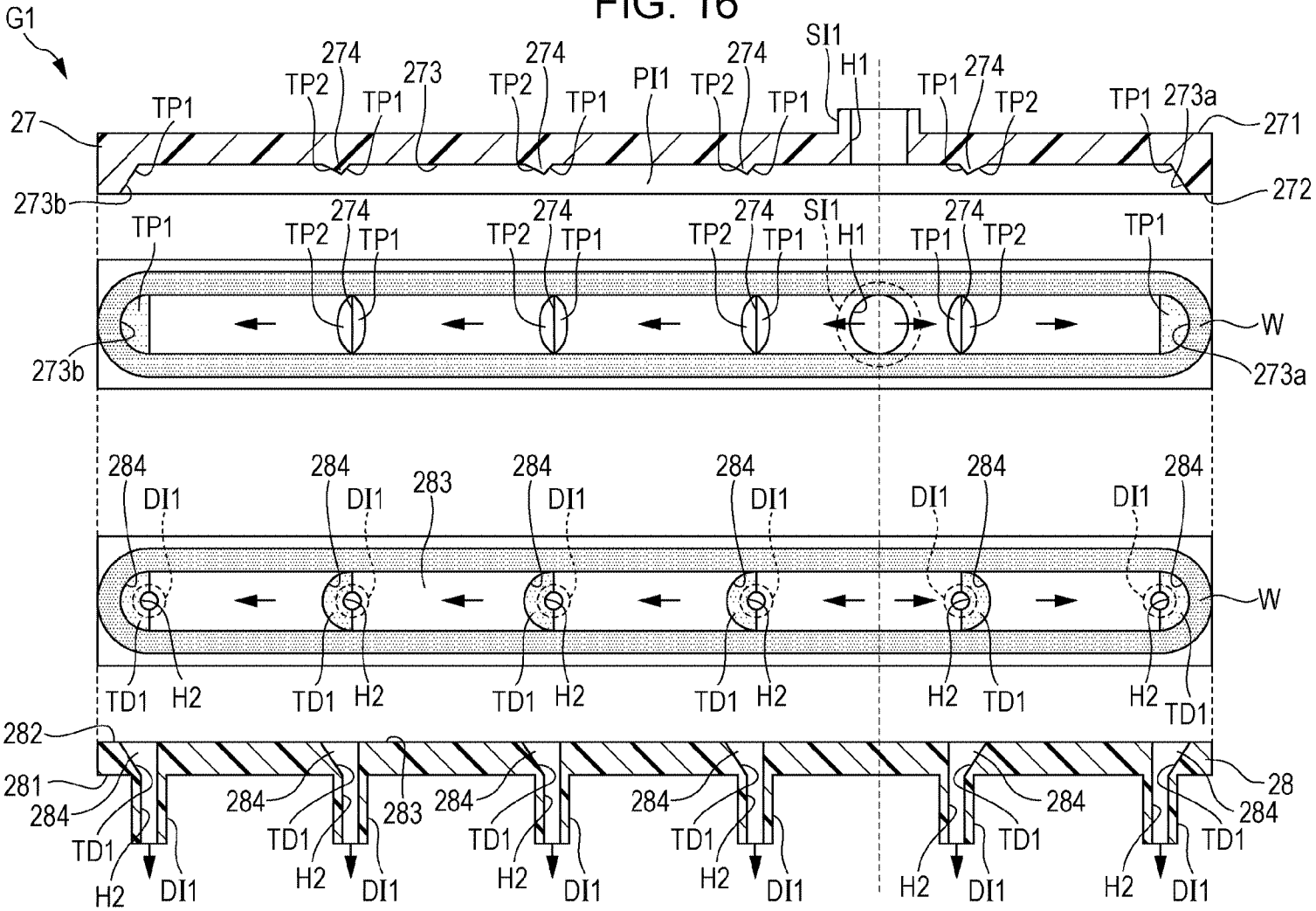
FIG. 16 is a side view and a plan view of a substrate which configures a part of the flow path structure illustrated in FIG. 15.
Figure 17:
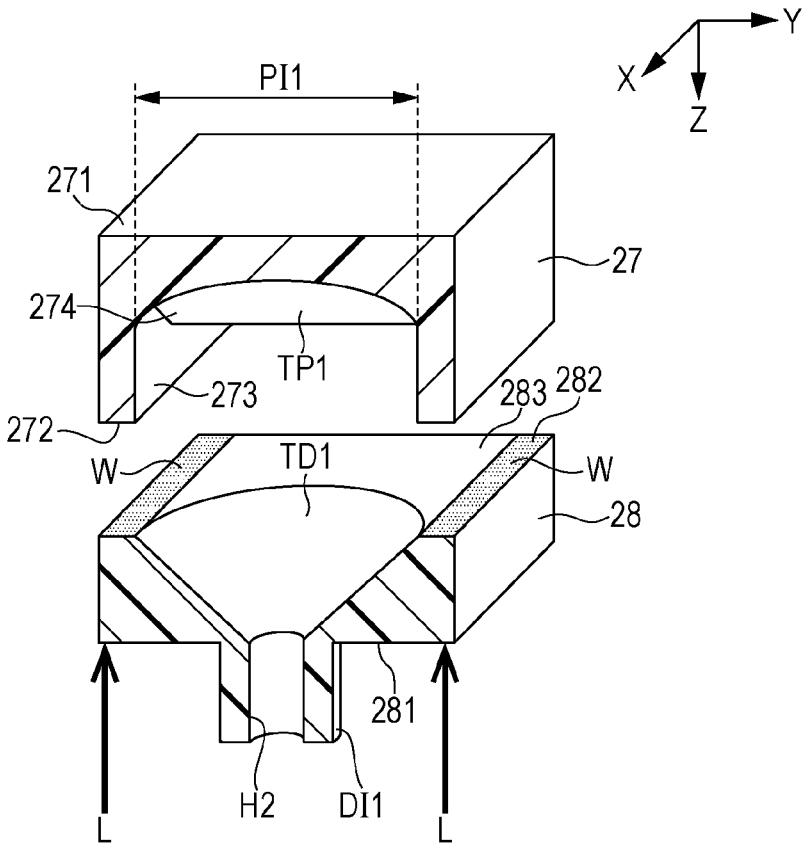
FIG. 17 is a sectional perspective view of a part of the flow path structure illustrated in FIG. 15 taken along the line XVII-XVII.

FIG. 15 is a sectional view illustrating a configuration of the flow path structure G1 in the second embodiment. FIG. 15 corresponds to FIG. 10, and is a partial sectional view of one system taken along line X-X when the configuration of the second embodiment is employed in the flow path PI1 of the ink I of four systems of the flow path structure G1 illustrated in FIG. 7. FIG. 16 is a side view and a plan view of a case where the first substrate 27 and the second substrate 28 which configure a part of the flow path structure G1 illustrated in FIG. 15 are exploded, and corresponds to FIG. 11. FIG. 17 is a sectional perspective view taken along line XVII-XVII illustrated in FIG. 15, and corresponds to FIG. 9.

The flow path structure G1 of the second embodiment is a structure which has further devised the flow path structure of the flow path PI1 of the liquid of four systems in the first embodiment. Therefore, the part having functions similar to those of the flow path structure G1 of the first embodiment will be given the same reference numerals in FIGS. 15 to 17, and the specific description thereof will be omitted.

The flow path structure of the second embodiment illustrated in FIG. 15 is different from the flow path structure of the first embodiment illustrated in FIG. 10 in that an inclined surface TP1 on the flow path PI1 side illustrated in FIG. 17 and a tapered portion TD1 on the outlet flow path H2 side which are inclined in the direction of the flow of the flow path PI1, are formed in both of the end portions 273*a* and 273*b* of the flow path (first flow path) PI1, and at each branch point of the flow path PI1 and the outlet flow path (second flow path) H2.

In the flow path PI1 illustrated in FIG. 15, similar to the flow path PI1 illustrated in FIG. 10, since the outlet flow paths H2 are respectively disposed in each of both of the end portions 273*a* and 273*b* of the flow path PI1, and four outlet flow paths H2 are disposed between both of the end portions 273*a* and 273*b* of the flow path PI1, there are four branch points of the flow path PI1 and the outlet flow path H2.

Since the inlet flow path H1 is disposed on a side opposite to the outlet flow path H2 between both of the end portions 273*a* and 273*b* of the flow path PI1, the flow of the ink in the flow path PI1 is as follows. In other words, the ink which flows toward one end portion 273*a* of the flow path PI1 branches and is discharged respectively to the outlet flow path H2 of the end portion 273*a*, and to one outlet flow path H2 between the end portion 273*a* and the inlet flow path H1. The ink which flows toward the other end portion 273*b* of the flow path PI1 branches and is discharged respectively to the outlet flow path H2 of the end portion 273*b*, and to three outlet flow paths H2 between the end portion 273*b* and the inlet flow path H1. In the second embodiment, the inclined surface TP1 on the above-described flow path PI1 and the tapered portion TD1 on the outlet flow path H2 side are formed in both of the end portions 273*a* and 273*b* of the flow path PI1 and at branch point of four outlet flow paths H2.

Hereinafter, a configuration example of the inclined surface TP1 on the flow path PI1 side and the tapered portion TD1 on the outlet flow path H2 side will be described. First, the inclined surface TP1 on the flow path PI1 side will be described. As illustrated in FIGS. 15 and 16, at branch point of the end portions 273*a* and 273*b* of the flow path PI1, the inclined surface TP1 is formed on the wall surface of each of the end portions 273*a* and 273*b*.

Meanwhile, in each of four branch points between both of the end portions 273*a* and 273*b* of the flow path PI1, a projection portion 274 which protrudes toward the outlet flow path H2 from a part which opposes the outlet flow path H2 in the flow path PI1, is formed, and the inclined surface TP1 is formed on the wall surface on the upstream side of the projection portion 274. The inclined surface TP1 is inclined so that the height of the projection portion 274 increases toward the downstream side, with respect to the direction of the flow in the flow path PI1. In addition, the height of the projection portion 274 will be described later in detail.

In each projection portion 274, an inclined surface TP2 is also formed on the wall surface on the downstream side. The inclined surface TP2 is inclined on a side opposite to the inclined surface TP1, with respect to the direction of the flow in the first flow path. In other words, the inclined surface TP2 is inclined so that the height of the projection portion 274 decreases toward the downstream side. In this manner, as the inclined surface TP2 is also formed on the wall surface on the downstream side of the projection portion 274, compared to a case where the inclined surface TP2 is not formed on the downstream side, it is possible to suppress the stagnation further on the downstream side than the projection portion 274 in the flow path PI1.

Next, the tapered portion TD1 on the outlet flow path H2 side will be described. On each of six outlet flow paths H2, the enlarged diameter portion 284 is formed at a part opened on the second opposing surface 282 of the second substrate 28, and in the enlarged diameter portion 284, the tapered portion TD1 is formed to be widened in a tapered shape on the downstream side of the flow path PI1, toward the flow path PI1 (toward the negative side of the Z direction). The enlarged diameter portion 284 is a path from the outlet flow path H2 to the flow path PI1, and is a part at which the flow path diameter continuously increases from the outlet flow path H2 to the flow path PI1. As illustrated in FIGS. 16 and 17, the tapered portion TD1 is a part on the downstream side of the flow path PI1 on an inner circumferential surface of the enlarged diameter portion 284, and has a shape which is a half of a conical surface that gradually widens toward the second opposing surface 282 which opposes the first substrate 27. Since the enlarged diameter portion 284 of the outlet flow path H2 is opened to the second opposing surface 282 which opposes the first substrate 27 in the second substrate 28, the enlarged diameter portion 284 is likely to be formed in the outlet flow path H2.

In addition, in the second aspect, similar to the first embodiment, since the inlet flow path H1 is disposed between both of the end portions 273*a* and 273*b* of the flow path PI1, the directions of the flow in the flow path PI1 become reverse to each other between the inlet flow path H1 and one end portion 273*a* (right side of FIG. 15), and between the inlet flow path H1 and the other end portion 273*b* (left side of FIG. 15). Therefore, the disposition positions of the inclined surface TP1 and the tapered portion TD1 are also revere to each other on the left and right sides of FIG. 15.

A relationship between the inclined surface TP1 and the tapered portion TD1 is as follows. As illustrated in the enlarged view of FIG. 15, the inclined surface TP1 on the upstream side of the projection portion 274 is disposed on an upper surface (a bottom surface 273*e* of the flow path groove 273) of the flow path PI1 which opposes the enlarged diameter portion 284 of the outlet flow path H2. In addition, when drawing a virtual line y which extends along the inclination of the inclined surface TP1 of the wall surface on the upstream side of the projection portion 274 in the sectional view of FIG. 15, the virtual line y passes through a region (including a boundary line between the tapered portion TD1 and the second opposing surface 282) in which the tapered portion TD1 of the enlarged diameter portion 284 is formed. According to this, at each branch point, it is possible to guide a part of the flow of the ink of the flow path PI1, to the tapered portion TD1 of the enlarged diameter portion 284, along the inclined surface TP2 on which the wall surface on the upstream side of the projection portion 274 extends. Accordingly, since the flow of the ink of the flow path PI1 is likely to flow to the outlet flow path H2, it is possible to effectively improve the discharge performance of the bubbles.

The inclined surface TP1 of the end portions 273*a* and 273*b* of the flow path PI1 has a shape similar to that of the tapered portion TD1, and is formed vertically reverse to the tapered portion TD1. In other words, the inclined surface TP1 has a shape of a half of the conical surface which gradually widens toward the first opposing surface 272 which opposes the second substrate 28. The first opposing surface 272 and the second opposing surface 282 are joined to each other so that a boundary line having a shape of an arc between the inclined surface TP1 and the first opposing surface 272, and a boundary line having a shape of an arc between the tapered portion TD1 and the second opposing surface 282, match each other. Accordingly, in the end portions 273*a* and 273*b* of the flow path PI1, since the inclined surface TP1 and the tapered portion TD1 communicate with each other, the flow of the ink toward the outlet flow path H2 of the end portions 273*a* and 273*b* from the flow path PI1 can be smoother.

Figure 18:
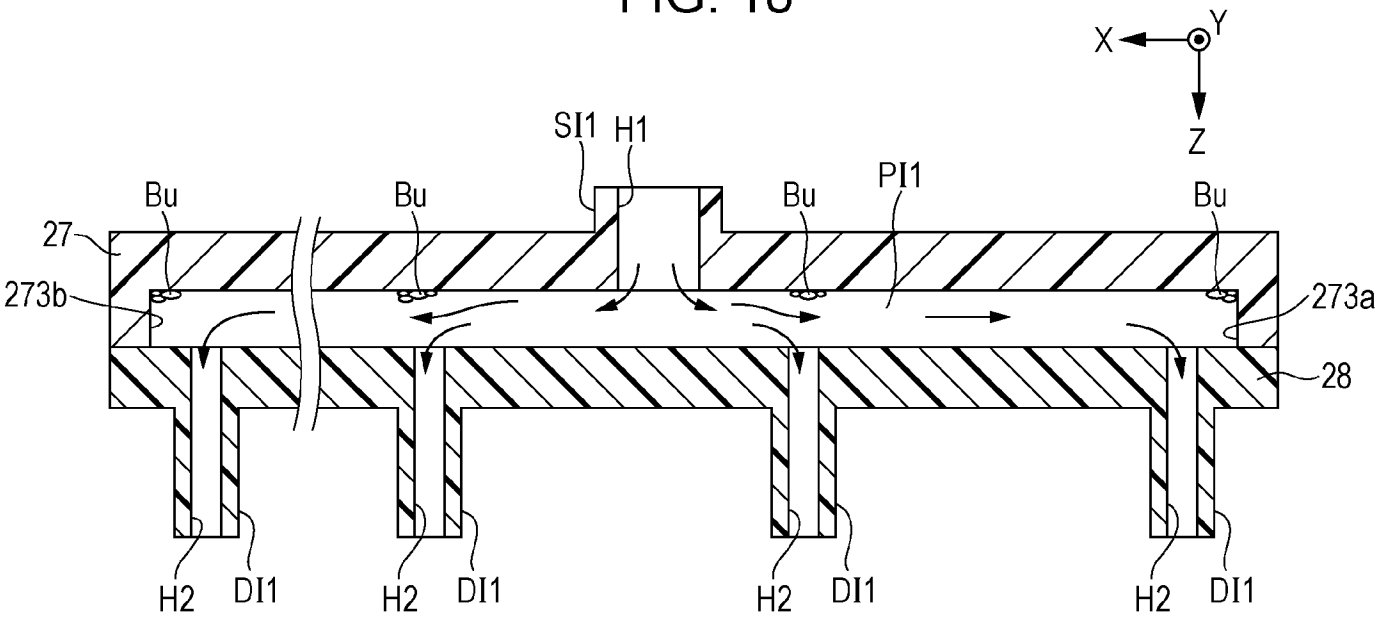
FIG. 18 is a view illustrating an action of a part of the flow path structure in a second comparative example.

An action effect of the flow path structure G1 of the second embodiment will be described comparing a second comparative example. FIG. 18 is a view which enlarges a partial section of the flow path structure G1 in the second comparative example in which the inclined surface TP1 and the tapered portion TD1 are not formed, and FIG. 19 is a view which enlarges a partial section of the flow path structure G1 in the second embodiment in which the inclined surface TP1 and the tapered portion TD1 are not formed.

As illustrated in the second comparative example of FIG. 18, in a case where the inclined surface TP1 and the tapered portion TD1 are not formed, the stagnation of the ink is generated not only at the branch point of both of the end portions 273*a* and 273*b* of the flow path PI1 but also at the branch point between both of the end portions 273*a* and 273*b* of the flow path PI1, and bubbles Bu are likely to stay. This is because the stagnation of the ink is likely to be generated at a part (upper part of the flow path PI1 at the branch point of FIG. 18) which opposes each outlet flow path H2, since the flow of the ink along the flow path PI1 is pulled to the outlet flow path H2 at each branch point.

Figure 19:
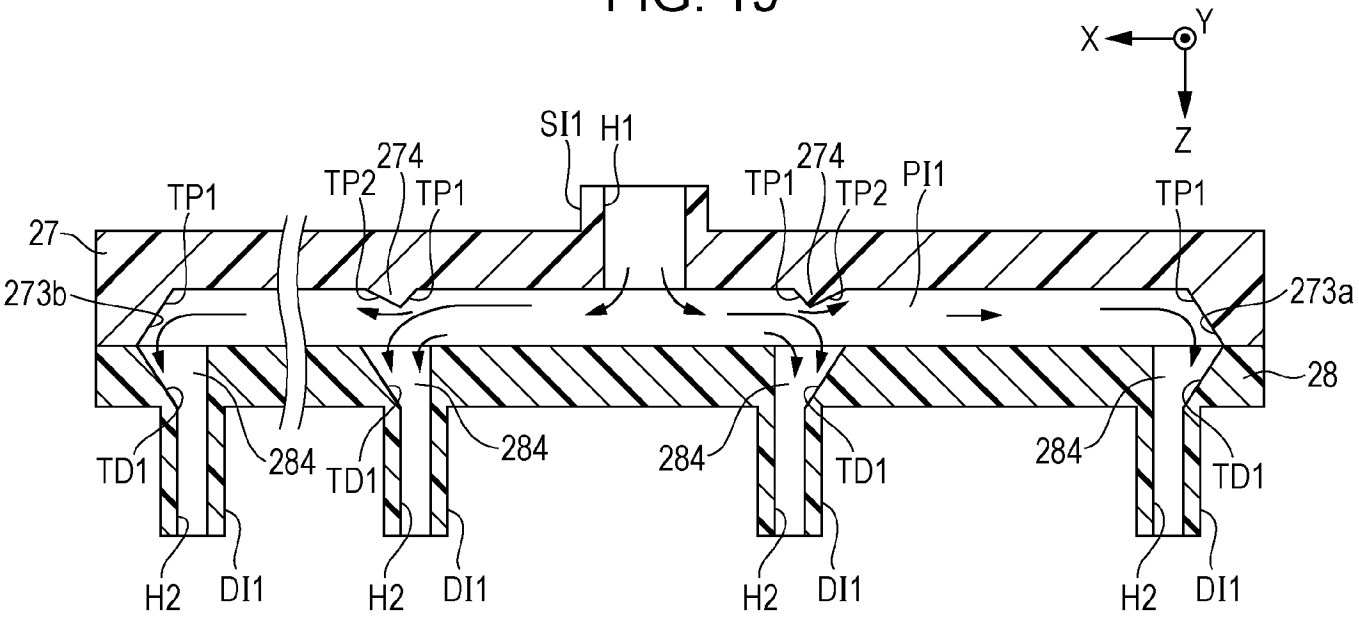
FIG. 19 is a view illustrating an action of a part of the flow path structure in the second embodiment.

Meanwhile, in the second embodiment illustrated in FIG. 19, in both of the end portions 273*a* and 273*b* of the flow path PI1, since the inclined surface TP1 and the tapered portion TD1 which are inclined in the direction of the flow of the flow path PI1 are formed, the flow is formed along the inclined surface TP1 and the tapered portion TD1. Furthermore, even at the branch point between the end portions 273*a* and 273*b* of the flow path PI1, since the inclined surface TP1 and the tapered portion TD1 which are inclined in the direction of the flow of the flow path PI1, are formed, a part of the liquid which flows in the flow path PI1 is oriented toward the tapered portion TD1 on the inclined surface TP1, and the flow along the inclined surface TP1 and the tapered portion TD1 is formed. Accordingly, the stagnation of the ink is suppressed not only in both of the end portions 273*a* and 273*b* of the flow path PI1 but also at each branch point, and the bubbles are likely to be discharged from each outlet flow path H2. Accordingly, it is possible to improve the discharge performance of the bubbles at each branch point.

Furthermore, in the second embodiment, similar to the first embodiment, since the flow path pipe DI1 is disposed to include the entire pipe surface (outer circumference) thereof, and to be included in the region of the flow path PI1 in a plan view, it is also possible to reduce welding unevenness of the welding surface W due to the laser welding for forming the flow path PI1. In this manner, in the second embodiment, while improving the discharge performance of the bubbles at each branch point, it is also possible to reduce welding unevenness due to the laser welding.

In particular, without forming the above-described inclined surface TP1 on the wall surfaces of the end portions 273*a* and 273*b* of the flow path PI1, when the pipe surface of the flow path pipe DI1 is configured to be included in the region of each flow path PI1, as illustrated in FIG. 18, it is necessary to widen each of both of the end portions 273*a* and 273*b* of the flow path PI1 further on the downstream side than the outlet flow path H2 only by the pipe surface (outer circumference) of the flow path pipe DI1. Therefore, at a part which widens further on the downstream side than the outlet flow path H2 in the end portions 273*a* and 273*b* of the flow path PI1 flow path PI1, the stagnation of the ink is likely to be generated. At this point, since it is possible to suppress the stagnation of the ink of the end portions 273*a* and 273*b* of the flow path PI1 by forming the above-described inclined surface TP1 on the wall surfaces of the end portions 273*a* and 273*b* of the flow path PI1, it is possible to effectively improve the bubble discharge performance.

In addition, as illustrated in the enlarged view of FIG. 15, in each projection portion 274, it is preferable that an inclination angle θP1 of the inclined surface TP1 on the upstream side with respect to the direction of the flow of the flow path PI1, is greater than an inclination angle θP2 of the inclined surface TP2 on the downstream side with respect to the direction of the flow of the flow path PI1. In this manner, the ink which flows the flow path PI1 can be likely to flow to the outlet flow path H2. Accordingly, since it is possible to improve the suppression effect of the stagnation of each branch point, and the bubbles are more likely to be discharged from the outlet flow path H2, it is possible to further improve the discharge performance of the bubbles at each branch point. When considering this point from the inclined surface TP2 on the downstream side of each projection portion 274, since the inclination angle θP2 on the inclined surface TP2 on the upstream side is smaller than the inclination angle θP1 on the inclined surface TP1 on the upstream side, the flow of the ink which flows further on the downstream side than each projection portion 274 in the flow path PI1 become smoother, and it is possible to effectively reduce the stagnation of the liquid which flows further on the downstream side than the projection portion 274.

In addition, in the second embodiment, a case where both of the inclined surface TP1 and the tapered portion TD1 are formed at each branch point of the flow path PI1 and the outlet flow path H2, is described as an example, but the invention is not limited thereto, and only one of the inclined surface TP1 and the tapered portion TD1 may be formed. According to this, compared to a case where the inclined surface TP1 and the tapered portion TD1 are not provided, since it is possible to suppress the stagnation of each branch point, it is possible to likely to discharge the bubbles.

Figure 20:
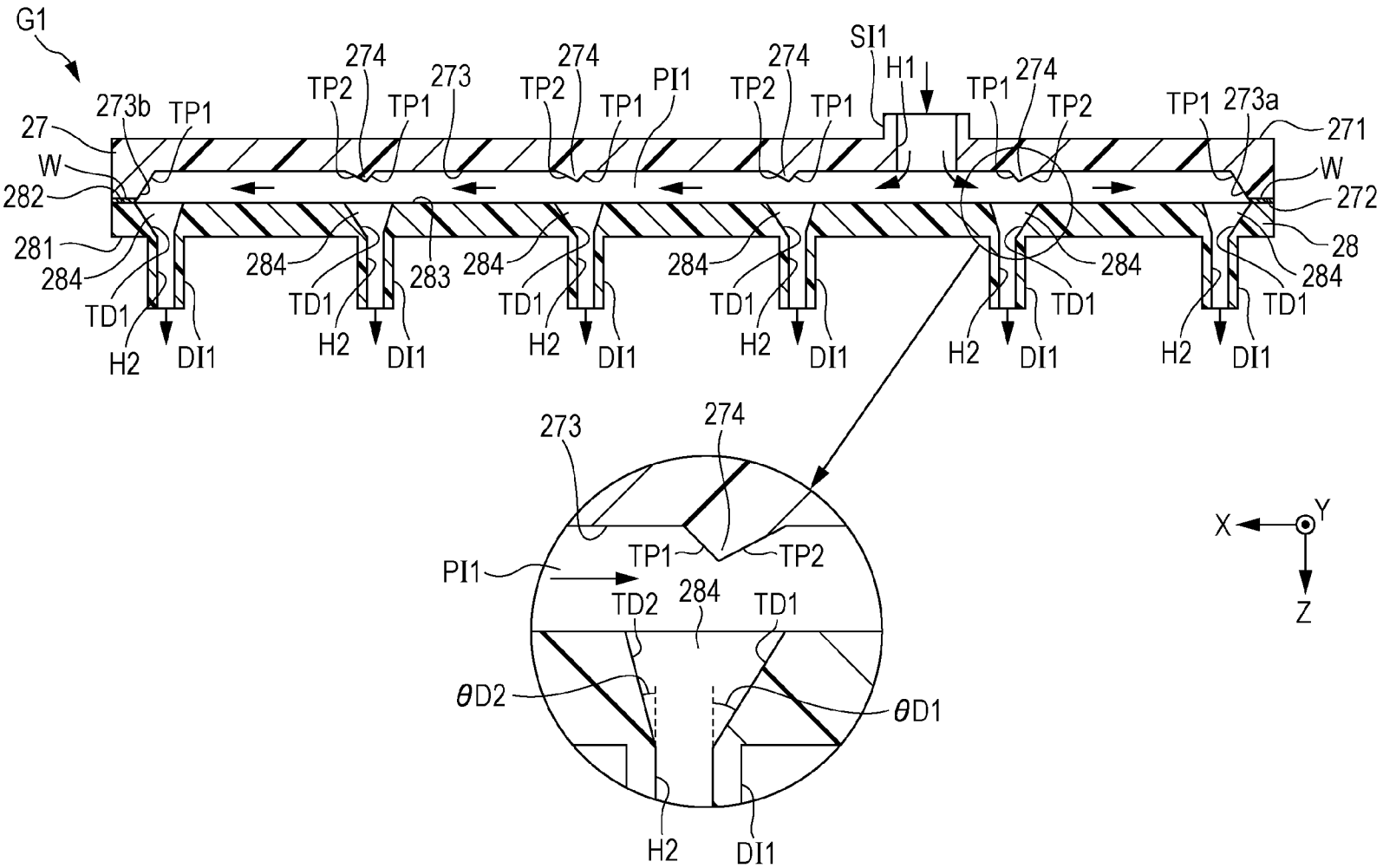
FIG. 20 is a partial sectional view of the flow path structure according to a modification example of the second embodiment.

In addition, the shape of the enlarged diameter portion 284 of the outlet flow path H2 of the flow path structure G1 is not limited to the shape illustrated in FIG. 15. For example, as illustrated in a modification example of FIG. 20, in the enlarged diameter portion 284 of the outlet flow path H2, when the tapered portion TD1 which widens to the downstream side of the flow path PI1 becomes a first tapered portion, a second tapered portion TD2 which widens not only to the first tapered portion TD1 but also to the opposite side, that is, the upstream side of the flow path PI1, may be provided. In other words, the second tapered portion TD2 is a part on the upstream side of the flow path PI1 on the inner circumferential surface of the enlarged diameter portion 284, and has a shape which is a half of the conical surface which gradually widens toward the second opposing surface 282 which opposes the first substrate 27.

According to this, since it is possible to enlarge the sectional area of the enlarged diameter portion 284 of the outlet flow path H2, it is possible to more likely to flow the ink to the outlet flow path H2 from the flow path PI1. In this case, as illustrated in the enlarged view of FIG. 20, it is preferable that an inclination angle θD1 of the first tapered portion TD1 with respect to the outlet flow path H2 becomes greater than an inclination angle θD2 of the second tapered portion TD2. Accordingly, compared to a case where the inclination angle θD1 of the first tapered portion TD1 and the inclination angle θD2 of the second tapered portion TD2 are the same inclination angle, since it is possible to prevent the sectional area of the outlet flow path H2 from being extremely large, it is possible to suppress deterioration of the flow velocity. In this manner, while suppressing deterioration of the flow velocity, it is possible to more likely to flow the ink to the outlet flow path H2 from the flow path PI1. Therefore, it is possible to further improve the discharge performance of the bubbles.

In addition, in the flow path structure G1 illustrated in FIG. 15, a case where the sectional area of the flow path PI1 on the section orthogonal to the flow direction of the flow path PI1 is the same between each branch point, is employed as an example, but the invention is not limited thereto, and the sectional area of the flow path PI1 further on the downstream side than the projection portion 274 may be smaller than the sectional area of the flow path PI1 further on the upstream side than the projection portion 274. According to this, it is possible to reduce the sectional area of the flow path PI1 between each branch point from the upstream side to the downstream side of the flow path PI1.

In a case where the sectional area of the flow path PI1 between each branch point from the upstream side to the downstream side of the flow path PI1 is the same, since the flow velocity of the ink which flows in the flow path PI1 is reduced when passing through the projection portion or the branch portion, the bubble discharge performance deteriorates. Here, by reducing the sectional area of the flow path PI1 between each branch point as described above from the upstream side to the downstream side of the flow path PI1, it is possible to suppress deterioration of the flow velocity further on the downstream side than the projection portion 274. Accordingly, it is possible to improve the discharge performance of the bubbles further on the downstream side than the projection portion 274.

Figure 21:
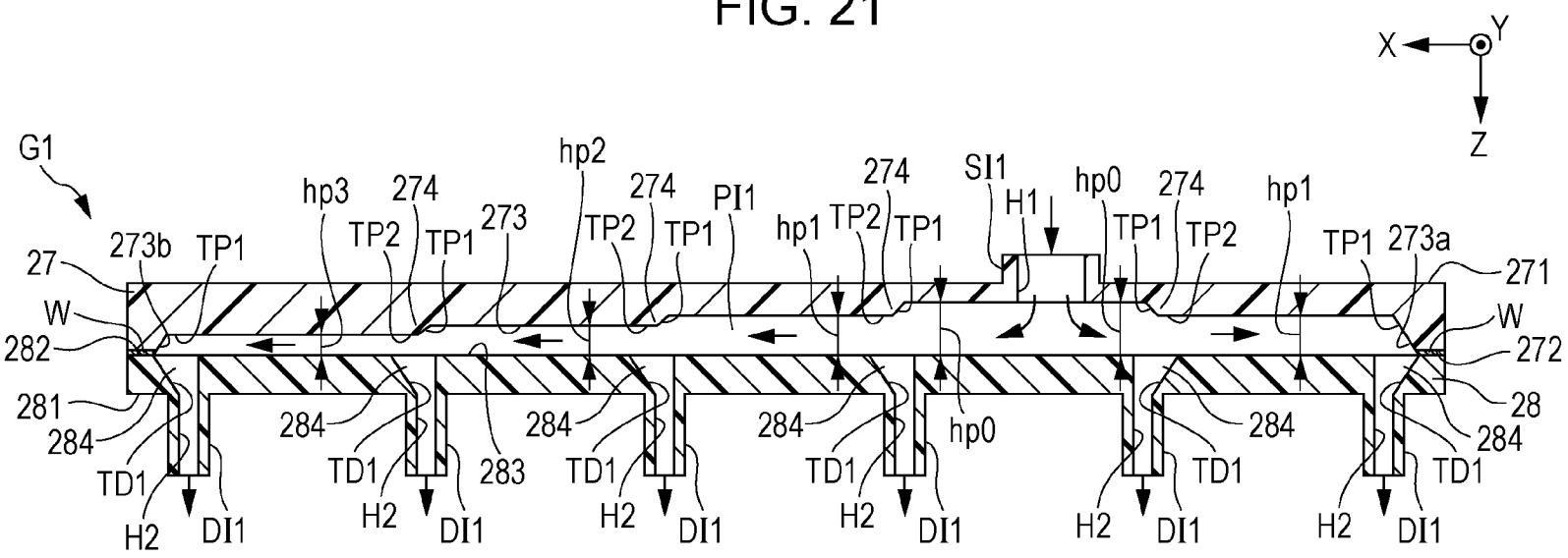
FIG. 21 is a partial sectional view of the flow path structure according to another modification example of the second embodiment.

In this case, for example, by changing the height of the flow path PI1 or the width of the flow path PI1 on the section orthogonal to the flow direction of the flow path PI1, it is possible to change the sectional area of the flow path PI1. Specifically, for example, another modification example of FIG. 21 is an example in which the height of the flow path PI1 further on the downstream side than the projection portion 274 decreases to be lower than the height of the flow path PI1 further on the upstream side than the projection portion 274, in the liquid path structure G1 of FIG. 15. The height of the flow path PI1 here is the height from a surface (the second opposing surface 282 of the second substrate 28 which becomes a lower surface of the flow path PI1 illustrated in FIG. 22 which will be described later) on the positive side in the Z direction to a surface (the bottom surface 273*e* of the flow path groove 273 which becomes an upper surface of the flow path PI1 illustrated in FIG. 22 which will be described later) on the negative side in the Z direction, on the inner wall surface of the space which configures the flow path PI1 on the section along the direction of the flow in the flow path PI1.

In the flow path structure G1 of FIG. 21, between the inlet flow path H1 on the upstream side and the end portion 273*a* on the downstream side of the flow path PI1, the height hp1 of the flow path PI1 further on the downstream side than the projection portion 274 decreases to be lower than the height hp0 of the flow path PI1 further on the upstream side than the projection portion 274. In addition, between the inlet flow path H1 on the upstream side and the end portion 273*b* on the downstream side of the flow path PI1, from the upstream side to the downstream side, the height of the flow path PI1 between each projection portion 274 gradually decreases to be hp0, hp1, hp2, and hp3 (hp0>hp1>hp2>hp3). According to this, from the upstream side to the downstream side of the flow path PI1, it is possible to reduce the sectional area of the flow path PI1 between each branch point. Accordingly, since it is possible to suppress deterioration of the flow velocity further on the downstream side than each projection portion 274, it is possible to improve the discharge performance of the bubbles further on the downstream side than each projection portion 274.

In addition, even in the flow path structure G1 of FIG. 21, similar to the first embodiment, the pipe surface (outer circumference) of the flow path pipe DI1 of the outlet flow path H2 is included in the region of the flow path PI1 surrounded by the welding surface. Accordingly, similar to the first embodiment, since it is possible to make the welding surface which surrounds the flow path PI1 not to overlap the pipe surface of the flow path pipe DI1, it is possible to effectively reduce welding unevenness of the welding surface formed by the laser welding.

Furthermore, similar to the flow path structure G1 of FIG. 21, in a case where the sectional area of the flow path PI1 is adjusted by the height of the flow path PI1, compared to a case where the sectional area of the flow path PI1 is adjusted by the width of the flow path PI1, there is not a case where the region of the flow path PI1 surrounded by the welding surface narrows. In a case where the width of the flow path PI1 is adjusted, in order to make the welding surface which surrounds the flow path PI1 not to overlap the pipe surface of the flow path pipe DI1, it is not necessary to adjust the size of the flow path pipe DI1 in accordance with the width of the flow path PI1. At this point, according to the flow path structure G1 of FIG. 21, since it is possible to adjust only the height of the flow path PI1 without changing the width of the flow path PI1, the effect is large because it is not necessary to adjust the size of the flow path pipe DI1 in accordance with the width of the flow path PI1 in order to make the welding surface which surrounds the flow path PI1 not to overlap the pipe surface of the flow path pipe DI1.

In addition, in a case where the sectional area of the flow path PI1 is adjusted by the height of the flow path PI1, as illustrated in FIG. 21, the inclination of the inclined surface TP1 on the upstream side of the projection portion 274 may change in accordance with the height of the flow path PI1. In FIG. 21, as the height of the flow path PI1 decreases, the inclination of the inclined surface TP1 on the upstream side of the projection portion 274 decreases. Accordingly, even when the height of the flow path PI1 changes, for example, it is possible to adjust the virtual line y (refer to the enlarged view of the FIG. 15) which extends along the inclination of the inclined surface TP1 on the upstream side of the projection portion 274 to pass through the tapered portion TD1 of the enlarged diameter portion 284 at all times.

In addition, in the flow path structure G1 of FIG. 21, a case where the inclined surface TP1 disposed at each branch point is formed on the upstream side of the projection portion 274 is employed, but the invention is not limited thereto. In a case where the height of the flow path PI1 is adjusted between each branch point as illustrated in FIG. 21, since a step is formed at a part of each branch point in which the height of the flow path PI1 changes, the inclined surface TP1 may be formed on the wall surface on the upstream side of the step.

Furthermore, in the flow path structure G1 of FIG. 21, a case where the height of the flow path PI1 between each branch point is adjusted is employed as an example, but the height of the projection portion 274 may be adjusted. According to this, it is possible to suppress deterioration of the flow velocity further on the downstream side than each projection portion 274. The height of the projection portion 274 here is the height from the forming surface (the bottom surface 273*e* of the flow path groove 273 which becomes the upper surface of the flow path PI1 illustrated in FIG. 22) of the projection portion 274 to a top portion 274*a* of the projection portion 274 on the section along the direction of the flow in the flow path PI1.

Figure 22:
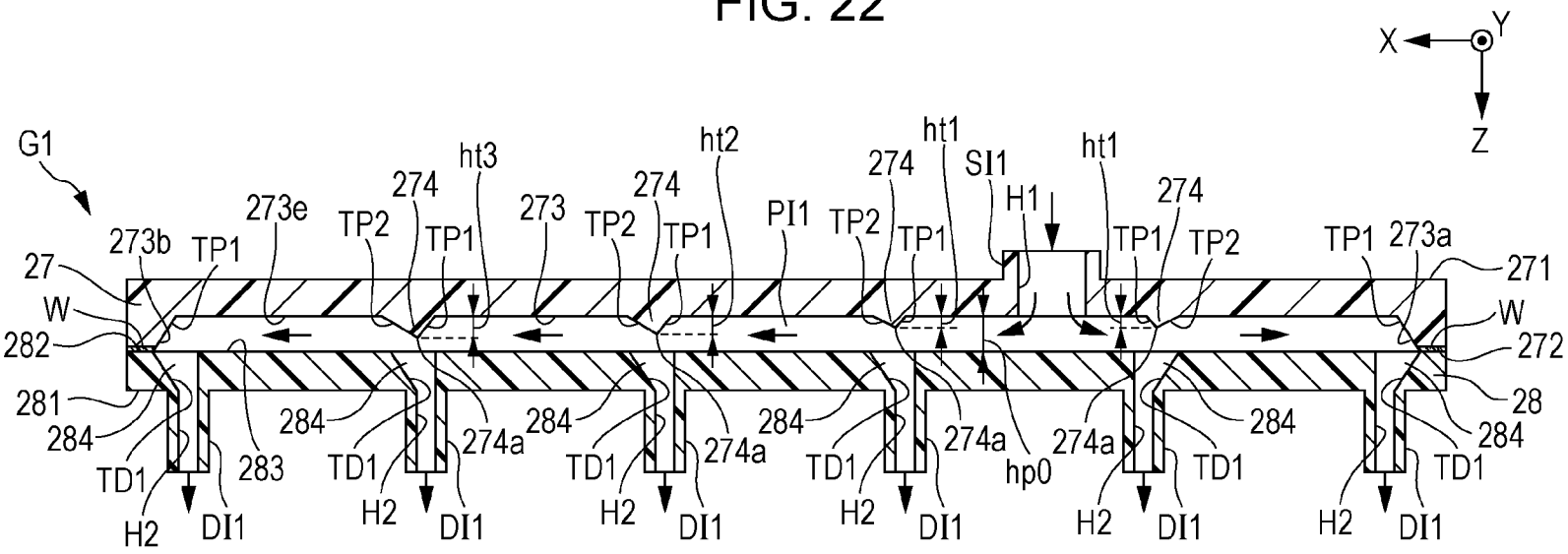
FIG. 22 is a partial sectional view of the flow path structure according to another modification example of the second embodiment.

For example, the flow path structure G1 illustrated in FIG. 22 is a structure in which the height of the projection portion 274 of the flow path structure G1 illustrated in FIG. 15 changes. Specifically, the height of each projection portion 274 from the inlet flow path H1 on the upstream side to the end portion 273*b* on the downstream side of the flow path PI1 gradually increases to be ht1, ht2, and ht3 (ht1<ht2<ht3). As the height of the projection portion 274 increases, since it is possible to narrow the sectional area of the flow path PI1 in the branch portion, it is possible to adjust the sectional area of the flow path PI1 at each branch point to gradually decrease from the upstream side to the downstream side of the flow path PI1. Accordingly, since it is possible to suppress deterioration of the flow velocity further on the downstream side than each projection portion 274, it is possible to improve the discharge performance of the bubbles further on the downstream side than each projection portion 274.

However, the flow velocity of the ink which flows in the flow path PI1 deteriorates when passing through each branch point from the upstream side to the downstream side of the flow path PI1 as described above. Therefore, it is preferable that the height of the projection portion 274 is adjusted in accordance with the flow velocity between each branch point in the flow path PI1. In this case, since it is possible to suppress deterioration of the flow velocity as the height of the projection portion 274 increases, to that extent, it is possible to improve the discharge performance of the bubbles. However, when the height of the projection portion 274 becomes extremely high, since the area of the wall surface (inclined surface TP1) of the projection portion 274 with which the flow of the ink in the flow path PI1 comes into contact increases, the pressure loss increases, and on the contrary, the flow velocity deteriorates. Therefore, in suppressing the increase in the pressure loss, it is preferable to adjust the height of the projection portion 274 not to become extremely high.

Hereinafter, a preferable range of the height of the projection portion 274 at each branch point for achieving both the effect of improving the discharge performance of the bubbles and the effect of suppressing the increase in the pressure loss, will be described. First, it is presumed that the flow velocity between each branch point in the flow path PI1 is the same. When the number of branch points from the upstream side to the downstream side in the flow path PI1 is N (1≤N), the number of branches between each branch point is N+1, the flow velocity V(M) at the M-th (1≤M≤N) branch point from the upstream side can be expressed by the following equation (1), and a total V(M+1) of the flow velocity at the M+1-th branch point further on the downstream side than the M-th branch point can be expressed in the following equation (2).

$$V(M)=[1/(N+1)]\times[(N+1)-(M-1)]=(N-M+2)/(N+1) \quad (1)$$

$$V(M+1)=[1/(N+1)]\times[(N+1)-M]=(N-M+1)/(N+1) \quad (2)$$

A ratio X of the height of the projection portion 274 with respect to the height hp of the path PI1 in the flow path PI1 can be expressed by the following expression (3).

$$1-V(M)\leq X\leq 1-V(M+1) \quad (3)$$

When the above-described equations (1) and (2) are substituted in the above-described expression (3), the ratio X of the height of the projection portion 274 can be expressed by the following expression (4).

$$1-(N-M+2)/(N+1)\leq X\leq 1-(N-M+1)/(N+1) \quad (4)$$

A preferable range of the height of the projection portion 274 at each branch point can be calculated by the above-described expression (4). For example, in the flow path structure G1 illustrated in FIG. 22, when the preferable range of the height of each projection portion 274 from the inlet flow path H1 on the upstream side of the flow path PI1 to the end portion 273*b* on the downstream side is calculated, the followings are achieved. First, since there are three branch points from the inlet flow path H1 on the upstream side to the end portion 273*b* on the downstream side of the flow path PI1, N=3, and thus, the branch between each branch point is N+1=4.

Here, each of ratios X1, X2, and X3 of the height ht1, ht2, and ht3 of the projection portion 274 with respect to the height hp of the flow path PI1, are respectively expressed by the following expressions (5), (6), and (7) in which N=3 is substituted and M=1, 2, 3 is respectively substituted in the above-described expression (4).

$$0\leq X1\leq 1/4 \quad (5)$$

$$1/4\leq X2\leq 2/4 \quad (6)$$

$$2/4\leq X1\leq 3/4 \quad (7)$$

According to this, with respect to the height hp of the flow path PI1, the heights ht1, ht2, and ht3 of each projection portion 274 in the range of the above-described expressions (5), (6), and (7), are set. In this manner, by setting the height of each projection portion 274 with respect to the height hp of the flow path PI1 within the range of the above-described expression (4), it is possible to achieve both the effect of improving the discharge performance of the bubbles and the effect of suppressing the increase in the pressure loss.

Figure 23:
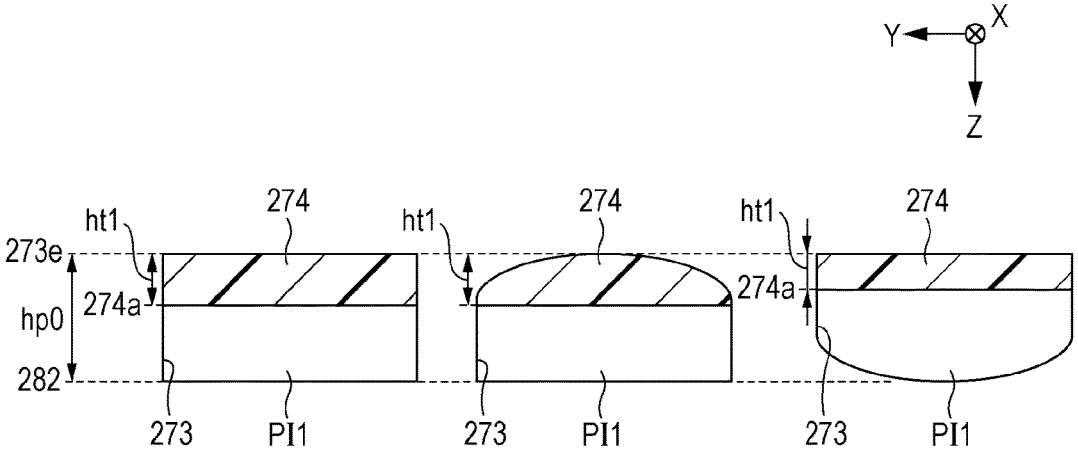
FIG. 23 is a sectional view illustrating a relationship between a sectional shape of the flow path and the height of the projection portion illustrated in FIG. 22.

In addition, according to the sectional shape of the flow path PI1, there is a case where the sectional area of the flow path PI1 becomes extremely small or extremely large even when the height of each projection portion 274 is the same. Therefore, accordingly, it is preferable that the height of each projection portion 274 is set within the range of the above-described expression (4). FIG. 23 illustrates a relationship between the sectional shape of the flow path PI1 on the section along the direction of the flow in the flow path PI1, and the height of the projection portion 274. The left side of FIG. 23 is a case where the sectional shape of the flow path PI1 is rectangular, and the center of FIG. 23 is a case where the sectional shape of the flow path PI1 is a shape (a shape having a part at which the flow path width narrows upwardly) projected upwardly. The right side of FIG. 23 is a case where the sectional shape of the flow path PI1 is a shape (a shape having a part at which the flow path width narrows downwardly) projected downwardly.

For example, since the width of the flow path PI1 becomes narrower further on the lower surface side than the upper surface side in a case (right side of FIG. 23) where the sectional shape of the flow path PI1 has a shape projected downwardly, even when the projection portion 274 having the same height is formed in a case (left side of FIG. 23) where the sectional shape of the flow path PI1 is rectangular, the sectional area of the flow path PI1 decreases. Therefore, as illustrated in FIG. 23, in a case (right side of FIG. 23) where the sectional shape of the flow path PI1 is a shape projected downwardly, as the height of the projection portion 274 decrease even in a case (left side of FIG. 23) where the sectional shape of the flow path PI1 is rectangular, it is possible to ensure the sectional area of the flow path PI1 similar to that of a case (left side of FIG. 23) where the sectional shape of the flow path PI1 is rectangular.

In addition, in the second embodiment, a case where the flow path groove 273 which configures the flow path PI1 is formed only on the first substrate 27 is employed as an example, but the invention is not limited thereto, and the flow path groove 273 may be formed only on the second substrate 28. In addition, the flow path groove which configures the flow path PI1 may be formed on both of the first substrate 27 and the second substrate 28, and may be joined to be accumulated by making the first substrate 27 and the second substrate 28 oppose each other so that each flow path groove opposes each other. However, in a case where the flow path groove 273 which configures the flow path PI1 is formed only on one of the first substrate 27 and the second substrate 28, compared to a case where the flow path groove 273 is formed on both of the first substrate 27 and the second substrate 28, when the flow path grooves of the first substrate 27 and the second substrate 28 are accumulated to oppose each other, even when a shift between the first substrate 27 and the second substrate 28 is generated, it is possible to form a so-called first flow path.

The printing apparatus 100 illustrated as an example in each of the above-described aspects can be employed in various apparatuses, such as a facsimile machine or a copy machine in addition to the apparatus dedicated to the printing. Moreover, the use of the liquid ejecting apparatus of the invention is not limited to the printing. For example, the liquid ejecting apparatus which ejects a solution of a color material, is used as a manufacturing apparatus which forms a color filter of a liquid crystal display apparatus. In addition, the liquid ejecting apparatus which ejects a solution of a conductive material is used as a manufacturing apparatus which forms wiring or electrode of a wiring substrate.

What is claimed is:

1. A flow path structure which forms a flow path of liquid, comprising:

a first substrate;

a second substrate joined to the first substrate; and a first flow path which is surrounded by a fixing surface on which the first substrate and the second substrate are fixed, wherein a second flow path which branches from the first flow path and in which the liquid flows in the direction intersecting with the fixing surface, is formed in one of the first substrate and the second substrate, wherein a projection portion which protrudes toward the second flow path at a branch point of the first flow path and the second flow path is formed in the other one of the first substrate and the second substrate, wherein the projection portion includes a wall surface on the upstream side and a wall surface on the downstream side in the first flow path, and wherein the wall surface on the upstream side of the projection portion has an inclined surface which is inclined so that the height of the projection portion increases toward the downstream side with respect to the direction of the flow in the first flow path.

2. The flow path structure according to claim 1, wherein the wall surface on the downstream side of the projection portion has the inclined surface which is inclined so that the height of the projection portion decreases toward the downstream side with respect to the direction of the flow in the first flow path, and wherein the inclination angle of the wall surface on the upstream side of the projection portion with respect to the direction of the flow in the first flow path is greater than the inclination angle of the wall surface on the downstream side of the projection portion with respect to the direction of the flow in the first flow path.

3. The flow path structure according to claim 1, wherein, in the sectional area of the first flow path on the section orthogonal to the direction of the flow in the first flow path, the sectional area of the first flow path further on the downstream side than the projection portion, is smaller than the sectional area of the first flow path further on the upstream side than the projection portion.

4. The flow path structure according to claim 3, wherein the first substrate is the light absorbing member having absorbing properties with respect to the laser light, wherein the second substrate is the light transmitting member having transmitting properties with respect to the laser light, wherein the fixing surface which surrounds the first flow path is the welding surface which is welded by the laser light, wherein the second flow path is formed in the flow path pipe which protrudes from the front surface opposite to the welding surface in the second substrate and is included in the region of the first flow path in a plan view from the direction orthogonal to the welding surface, and wherein the height of the first flow path further on the downstream side than the projection portion is lower than the height of the first flow path further on the upstream side than the projection portion, among the heights of the first flow path on the section orthogonal to the direction of the flow in the first flow path.

5. The flow path structure according to claim 1, wherein the second flow path includes the enlarged diameter portion having a tapered portion which widens in a tapered shape to the downstream side of the first flow path, toward the branch point of the first flow path, and wherein when the projection portion and the enlarged diameter portion of second flow path are viewed in a plan view on the section along the direction of the flow in the first flow path, a virtual line which extends from the wall surface on the upstream side of the projection portion along the inclined surface passes through the region in which the tapered portion of the enlarged diameter portion is formed.

6. The flow path structure according to claim 1, wherein the plurality of second flow paths which branch from the first flow path are provided, and wherein in a case where there are N ($1 \leq N$) branch points on the downstream side of a first branch point toward the downstream side from the upstream side of the first flow path, among a plurality of branch points of the first flow path and the second flow path, when the height of the first flow path on the section orthogonal to the direction of the flow in the first flow path is hp, and when a ratio of the height of the projection portion with respect to the height hp of the first flow path is X, the ratio X of the height of the projection portion of an M-th ($1 \leq M \leq N$) branch point from the upstream side of the first flow path, is within a range of $1-(N-M+2)/(N+1)<X<1-((N-M+1)/(N+1))$.

7. The flow path structure according to claim 1, wherein the first substrate is the light absorbing member having absorbing properties with respect to the laser light, wherein the second substrate is the light transmitting member having the transmitting properties with respect to the laser light, wherein the fixing surface which surrounds the first flow path is the welding surface which is welded by the laser light, and wherein the first flow path is formed in one of first substrate and the second substrate.

8. A liquid ejecting head comprising:

the flow path structure according to claim 1; and nozzles which eject the liquid from the flow path structure by driving of a driving element.

9. A liquid ejecting apparatus comprising:

a transporting mechanism which transports a medium; and the liquid ejecting head according to claim 8 which ejects liquid to the medium.

* * * * *